US010378486B2

(12) United States Patent
Dudar

(10) Patent No.: US 10,378,486 B2
(45) Date of Patent: Aug. 13, 2019

(54) SYSTEMS AND METHODS FOR DIAGNOSING A VEHICLE FUEL SYSTEM AND EVAPORATIVE EMISSIONS CONTROL SYSTEM

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 60 days.

(21) Appl. No.: 15/670,665

(22) Filed: Aug. 7, 2017

(65) Prior Publication Data

US 2019/0040822 A1 Feb. 7, 2019

(51) Int. Cl.

| | |
|---|---|
| ***G07C 5/00*** | (2006.01) |
| ***G07C 5/08*** | (2006.01) |
| ***F02M 25/08*** | (2006.01) |

(52) U.S. Cl.

CPC .... *F02M 25/0827* (2013.01); *F02M 25/0818* (2013.01); *F02M 25/0836* (2013.01); *G07C 5/008* (2013.01); *G07C 5/0808* (2013.01)

(58) Field of Classification Search

CPC ..... F02M 25/0818; F02M 25/0827; F02M 25/0836; G07C 5/008; G07C 5/0808

USPC ..... 701/29.3

See application file for complete search history.

(56) References Cited

U.S. PATENT DOCUMENTS

| | | | | |
|---|---|---|---|---|
| 6,314,797 | B1 * | 11/2001 | Dawson | F02M 25/0809 73/49.2 |
| 6,321,727 | B1 * | 11/2001 | Reddy | F02M 25/0809 123/520 |
| 9,026,345 | B2 | 5/2015 | Dudar et al. | |
| 9,340,106 | B2 | 5/2016 | Dudar et al. | |
| 2011/0139130 | A1 * | 6/2011 | Siddiqui | F02M 25/0818 123/520 |
| 2012/0152210 | A1 * | 6/2012 | Reddy | F02M 25/089 123/520 |
| 2012/0215399 | A1 * | 8/2012 | Jentz | G01M 3/025 701/32.8 |

(Continued)

OTHER PUBLICATIONS

Dudar, A. et al., "Fuel Tank Pressure Sensor Rationality Testing Using V2X Technology," U.S. Appl. No. 15/168,605, filed May 31, 2016, 83663404 (FGT163099), 64 pages.

(Continued)

*Primary Examiner* — Atul Trivedi

(74) *Attorney, Agent, or Firm* — Julia Voutyras; McCoy Russell LLP

(57) ABSTRACT

Methods and systems are provided for conducting an engine-off-natural-vacuum (EONV) test diagnostic on a vehicle fuel system and evaporative emissions system. In one example, a method may include setting an initial vent duration for the EONV test as a function of a likelihood that the vehicle will pass the EONV test during a pressure phase portion, or during a vacuum phase portion, and commencing the EONV test with the vacuum phase portion responsive to the likelihood that the vehicle will pass during the vacuum phase portion. In this way, battery power may be conserved and fuel economy improved, by avoiding a pressure phase portion of the EONV test if it is indicated that the vehicle is not expected to pass the EONV test during the pressure phase portion.

19 Claims, 10 Drawing Sheets

(56) References Cited

U.S. PATENT DOCUMENTS

2013/0253799 A1* 9/2013 Peters ..... F02M 25/0818 701/102
2013/0338855 A1* 12/2013 Mason ..... G07C 5/0816 701/2
2014/0060160 A1* 3/2014 Pursifull ..... F02M 25/0809 73/40
2014/0069394 A1* 3/2014 Jentz ..... F02M 25/0809 123/520
2014/0074385 A1* 3/2014 Dudar ..... F02M 25/0818 701/113
2014/0107906 A1* 4/2014 Jentz ..... F02M 37/0088 701/102
2014/0130781 A1* 5/2014 Jentz ..... F02M 25/0809 123/520
2015/0046026 A1* 2/2015 Pearce ..... G07C 5/00 701/33.9
2015/0114089 A1* 4/2015 Dudar ..... F02M 25/0809 73/40
2015/0211952 A1* 7/2015 Yang ..... G01M 3/025 73/40.5 R
2015/0219522 A1* 8/2015 Tseng ..... F02M 25/0809 701/102
2015/0371462 A1* 12/2015 Ramesh ..... G07C 5/0808 701/29.3
2016/0025589 A1 1/2016 Tseng et al.
2016/0032872 A1* 2/2016 Dudar ..... F02M 25/0809 73/40.5 R
2016/0053726 A1* 2/2016 Dudar ..... F02M 25/089 123/520
2016/0069771 A1* 3/2016 Makki ..... F02M 25/0809 73/40.5 R
2016/0084175 A1* 3/2016 Dudar ..... F02M 25/0818 123/521
2016/0160808 A1* 6/2016 Dudar ..... F02M 25/0809 701/104
2016/0186695 A1* 6/2016 Dudar ..... F02M 25/0809 73/40.5 R
2016/0290286 A1* 10/2016 Dudar ..... F02M 25/0836
2017/0067414 A1* 3/2017 Dudar ..... F02M 25/0809
2017/0089304 A1* 3/2017 Dudar ..... F02M 65/003
2017/0114744 A1* 4/2017 Martin ..... F02M 25/0818
2017/0130680 A1* 5/2017 Dudar ..... F02M 25/0809
2017/0167909 A1* 6/2017 Dudar ..... G01L 27/002
2017/0198662 A1* 7/2017 Dudar ..... F02D 41/0042
2017/0198671 A1* 7/2017 Dudar ..... F02M 25/089
2017/0204796 A1* 7/2017 Dudar ..... F02D 41/0035
2017/0211517 A1* 7/2017 Dudar ..... F02M 25/0827
2017/0292475 A1* 10/2017 Dudar ..... F02M 25/0809
2017/0342931 A1* 11/2017 Dudar ..... F02D 41/222
2017/0350351 A1* 12/2017 Lucka ..... F02M 25/0818
2018/0058384 A1* 3/2018 Dudar ..... F02D 41/221
2018/0066595 A1* 3/2018 Dudar ..... F02D 41/0037

OTHER PUBLICATIONS

Dudar, A. et al., "Systems and Methods for Intelligent Vehicle Evaporative Emissions Diagnostics," U.S. Appl. No. 15/389,195, filed Dec. 12, 2016, 83686886 (FGT163200), 113 pages.

* cited by examiner

SYSTEMS AND METHODS FOR DIAGNOSING A VEHICLE FUEL SYSTEM AND EVAPORATIVE EMISSIONS CONTROL SYSTEM

FIELD

The present description relates generally to methods and systems for diagnosing a presence or absence of undesired evaporative emissions in a vehicle fuel system and evaporative emissions system.

BACKGROUND/SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of undesired vapor emissions that could release fuel vapors to the atmosphere. Undesired vapor emissions may be identified using engine-off-natural-vacuum (EONV) during conditions when a vehicle engine is not operating. In particular, a fuel system and evaporative emissions control system may be isolated at an engine-off event. The pressure in such a fuel system may increase during a pressure phase portion of the EONV test if the tank is heated further (e.g., from hot exhaust or a hot parking surface) as liquid fuel vaporizes. A pressure rise above a threshold may indicate an absence of undesired fuel system vapor emissions. Alternatively, in the absence of a pressure rise above a threshold, as a fuel system cools down, a vacuum may be generated therein during a vacuum phase of the EONV test as fuel vapors condense to liquid fuel. Vacuum generation may be monitored and undesired vapor emissions identified based on expected vacuum development or expected rates of vacuum development.

Entry conditions and thresholds for an EONV test may be based on an inferred total amount of heat rejected into the fuel tank during the prior drive cycle. The inferred amount of heat may be based on engine run-time, integrated mass air flow, fuel level, ambient temperature, reid vapor pressure, etc. While these heat rejection inferences work well in most conditions, they may be prone to errors when noise factors are involved. For example, if a vehicle is driven downhill for an extended period, driven under rainy and/or windy conditions, or under conditions where a period of high-speed driving is followed by a period of idling, much of the heat rejection to the fuel tank may be negated. As a result, in an example where an EONV test is executed based on a heat rejection inference where the above-described noise factors are involved may result in a false failure. Furthermore, relying solely on heat rejection for conducting EONV diagnostics may be problematic for hybrid vehicles, where engine run-time may be limited, thus limiting an amount of heat rejected from the engine for particular drive cycles.

Still further, a typical EONV test may be enabled to run for a predetermined time duration (e.g. 45 minutes), where the time limit may be a function of battery power. Accordingly, if a vehicle initiates an EONV test at a vehicle-off event, and the vehicle does not pass during the pressure phase of the EONV test, then the time spent conducting the pressure phase decreases an amount of time for the vacuum phase portion of the EONV test to be conducted. If the vehicle does not then pass during the vacuum phase portion within the allotted predetermined time duration (e.g. 45 minutes), then the presence of undesired evaporative emissions may be falsely indicated in a case where the fuel system and evaporative emissions system are free from undesired evaporative emissions. In addition to the potential false indication of the presence of undesired evaporative emissions for an EONV test that did not pass on the pressure phase, and where the predetermined time duration expired prior to the EONV test passing on the vacuum phase, such a test wastes battery power, which may negatively impact fuel economy. Still further, such EONV tests that are initiated, but where the time limit expires prior to indicating a passing result, may additionally result in increased loading of a fuel vapor canister, increased wear and tear on valves that are actuated open or closed to conduct the EONV test, etc. Thus, a more intelligent means of determining when and how to execute diagnostic tests for undesired evaporative emissions, is desired.

The inventors have herein recognized the above-mentioned issues, and have developed systems and methods to at least partially address them. In one example, a method is provided, comprising setting an initial vent duration for an engine-off-natural-vacuum (EONV) test as a function of a likelihood that a vehicle will pass the EONV test during a pressure phase portion, or during a vacuum phase portion, and commencing the EONV test with the vacuum phase portion responsive to the likelihood the vehicle will pass during the vacuum phase portion. In this way, fuel economy may be improved and battery power may be conserved by avoiding the pressure phase portion if it is not likely to succeed or pass the EONV test.

As an example, the method may include commencing the EONV test with the vacuum phase portion and not conducting the pressure phase portion, regardless of whether the vehicle passes the vacuum phase portion or not.

As another example, responsive to the likelihood that the vehicle will pass the EONV test during the pressure phase portion, commencing the EONV test with the pressure phase portion, and then subsequently conducting the vacuum phase portion responsive to the vehicle not passing during the pressure phase portion.

As another example, passing the EONV test during the pressure phase portion may comprise pressure in a fuel system and evaporative emissions system of the vehicle reaching or exceeding a negative pressure threshold. In some examples, the fuel system and evaporative emissions system may be sealed from atmosphere during the pressure phase portion and vacuum phase portion of the EONV test.

Another examples includes where the initial vent duration is shorter given the likelihood that the vehicle will pass the EONV test during the pressure phase portion, as compared to the likelihood that the vehicle will pass during the vacuum phase portion. As an example, the initial vent duration may comprise 30-60 seconds given the likelihood that the vehicle will pass on the pressure phase portion, and where the initial vent duration may comprise greater than 30-60 seconds given the likelihood that the vehicle will pass on the vacuum phase portion. In some examples, the initial vent duration may be variable given the likelihood that the vehicle will pass on the vacuum phase portion.

As another example, the likelihood that the vehicle will pass during the pressure phase portion or during the vacuum phase portion includes retrieving a set of most recent EONV test results from a plurality of vehicles of a similar class as the vehicle, within a threshold radius of the vehicle, and responsive to an indication that the plurality of vehicles are tending to not pass the pressure phase portion of the engine-off-natural-vacuum test, commencing the EONV test with the vacuum phase portion of the EONV test. For example, retrieving the set of most recent EONV test results further comprises indicating that the set of most recent EONV results correspond to tests conducted subsequent to similar drive cycle and environmental conditions as a current drive cycle of the vehicle.

In another example, the likelihood that the vehicle will pass during the pressure phase portion or the vacuum phase portion further comprises retrieving current and forecast weather conditions just prior to conducting the engine-off-natural-vacuum test, and indicating whether weather conditions support the vehicle passing during the pressure phase portion or during the vacuum phase portion.

In still another example, the likelihood that the vehicle will pass during the pressure phase portion or during the vacuum phase portion is a function of learned driving routes and associated engine-off-natural-vacuum test results.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for conducting an engine-off natural-vacuum (EONV) evaporative emissions test diagnostic. More specifically, the description relates to systems and methods for determining when it may be appropriate or desirable to conduct the EONV test based on a positive pressure build in the fuel system and evaporative emissions system responsive to conditions being met for conducting the EONV test, or whether it may be desirable to conduct the EONV test based on a negative pressure build in the fuel system and evaporative emissions system responsive to conditions being met for conducting the EONV test. Determining whether to conduct the EONV test based on the positive pressure build or the negative pressure build may involve receiving data from a plurality of vehicles of a similar class to the vehicle being diagnosed, to indicate whether the other vehicle's are passing the EONV tests during a positive pressure build or during a negative pressure build. It may be understood that such data received from the plurality of vehicles may comprise data from the vehicle's under similar drive conditions as the vehicle being diagnosed (e.g. similar engine run-time, drive cycle aggressiveness, heat rejection to a fuel tank of the vehicle, outside environmental conditions, etc.) Determining how to conduct the EONV test may be further based on forecast weather conditions, and may further be based on learned driving routes for the vehicle being diagnosed. Accordingly the vehicle control system may be configured such that vehicle to vehicle (V2V) or vehicle to infrastructure (V2X) communications may be utilized to obtain test results from other vehicles and forecast weather conditions from databases or the internet, such as the vehicle control system depicted at FIG. 1. The EONV test may be conducted to determine the presence or absence of undesired evaporative emissions in a vehicle fuel system and evaporative emissions system, as depicted at FIG. 2.

Figure 3:
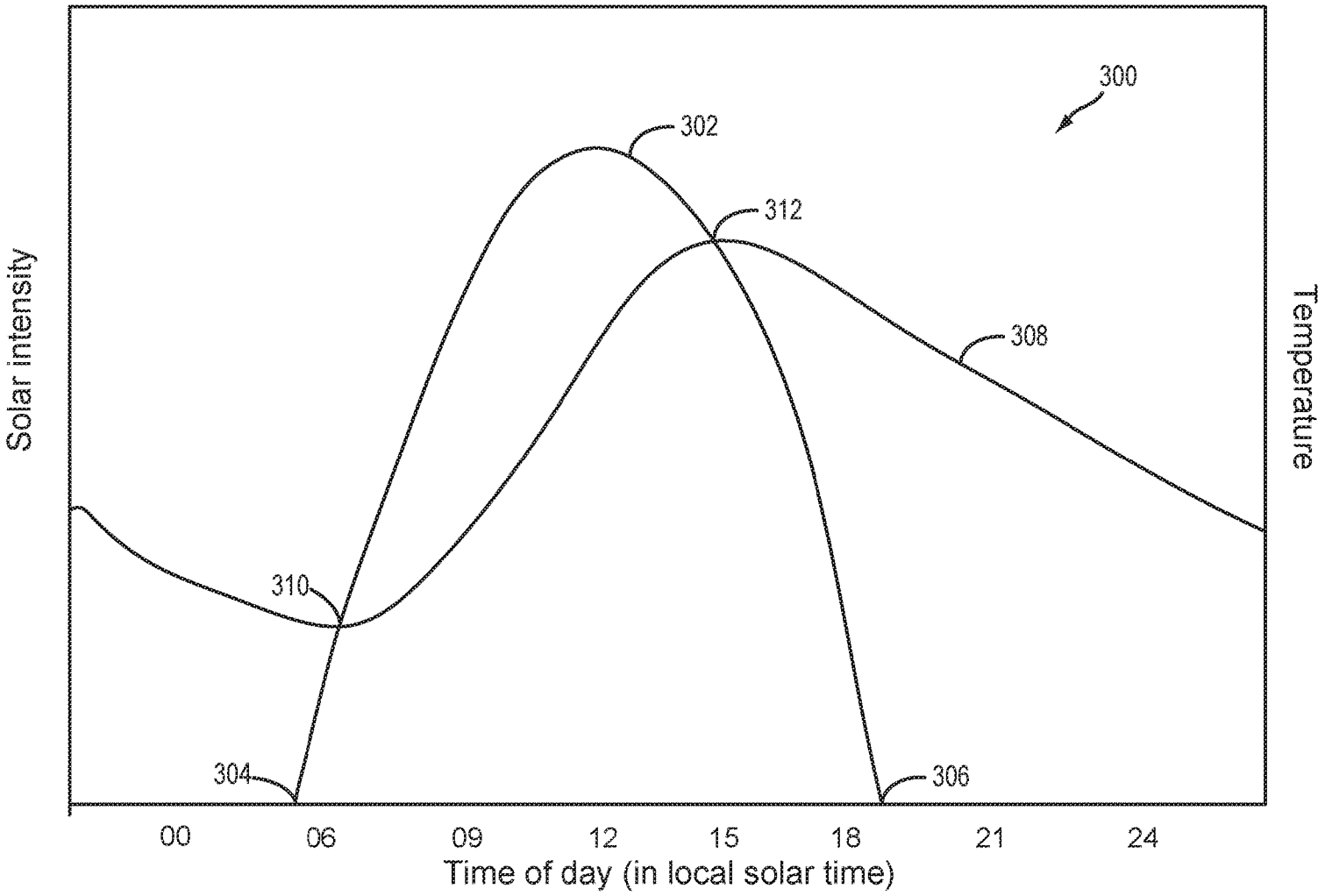
FIG. 3 schematically shows a graphic depiction of a diurnal cycle.
Figure 4:
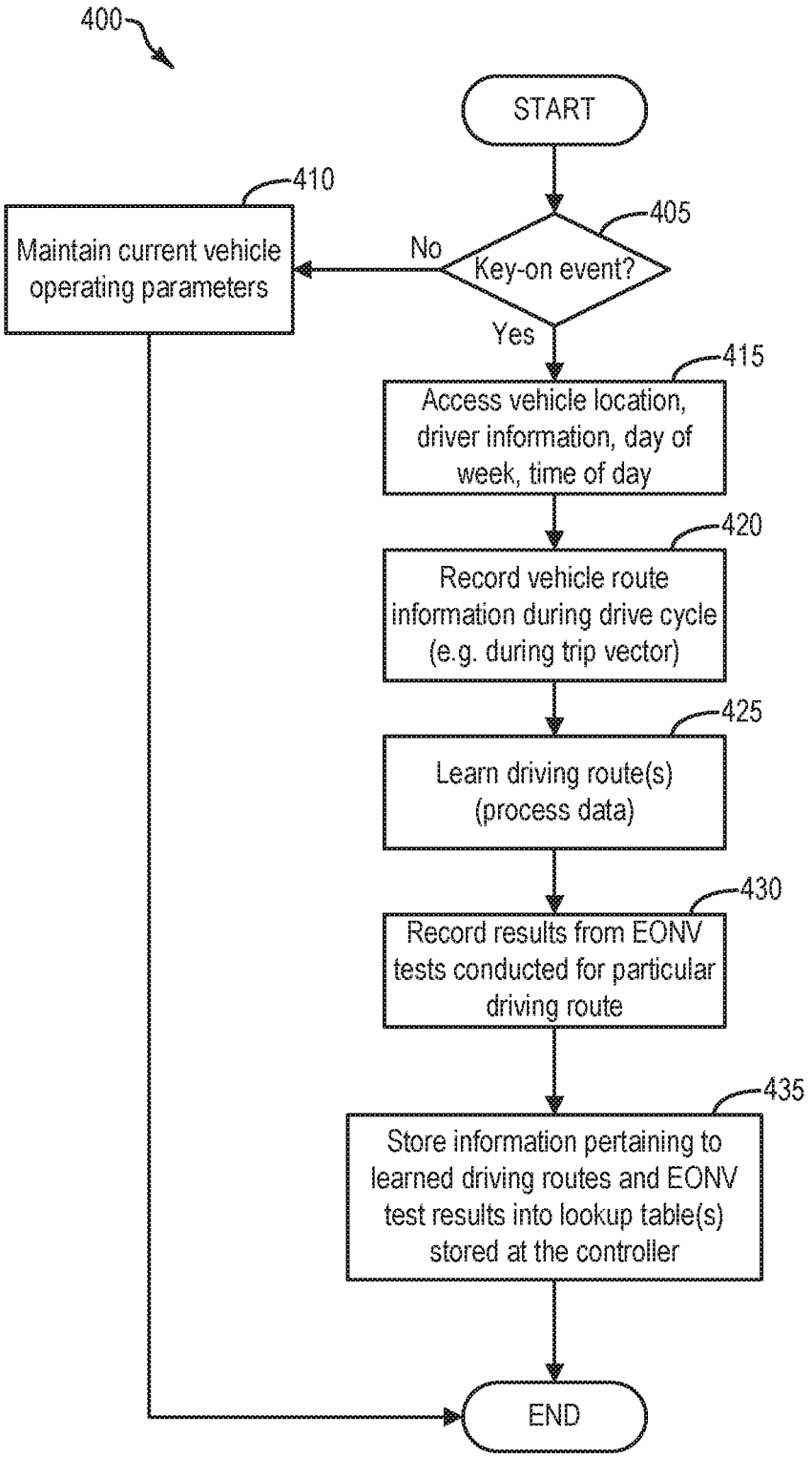
FIG. 4 shows a high-level flowchart for learning typical driving routes traveled by a vehicle.

In some examples, determining whether to conduct the EONV test based on the positive pressure build or the negative pressure (e.g. vacuum0 build may include determining whether a portion of the diurnal cycle comprises a heat gain portion, or a heat loss portion, as indicated at FIG. 3. As discussed above, in some examples information pertaining to prior EONV test results from learned driving routes and associated EONV test results may be utilized to determine whether to conduct the EONV test using the positive pressure build or the negative pressure build. Accordingly, a method for enabling the vehicle controller to learn commonly traveled routes and associated EONV test results typically obtained subsequent to completion of such routes, is depicted at FIG. 4.

Figure 5:
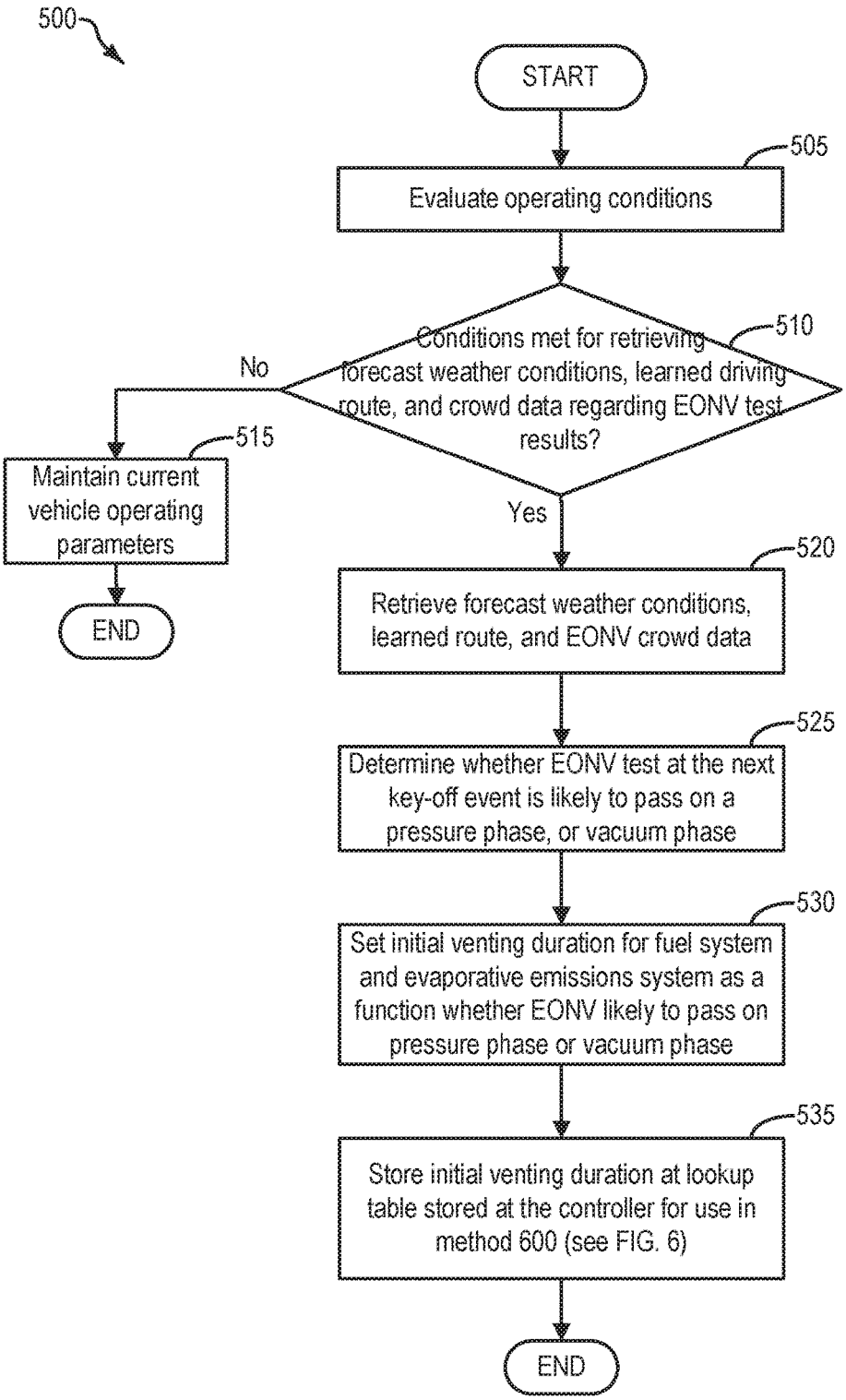
FIG. 5 shows a high-level flowchart for determining whether an EONV test at a key-off event is likely to pass on a pressure phase or vacuum phase of the EONV test, and setting an initial venting duration for such an EONV test.
Figure 6:
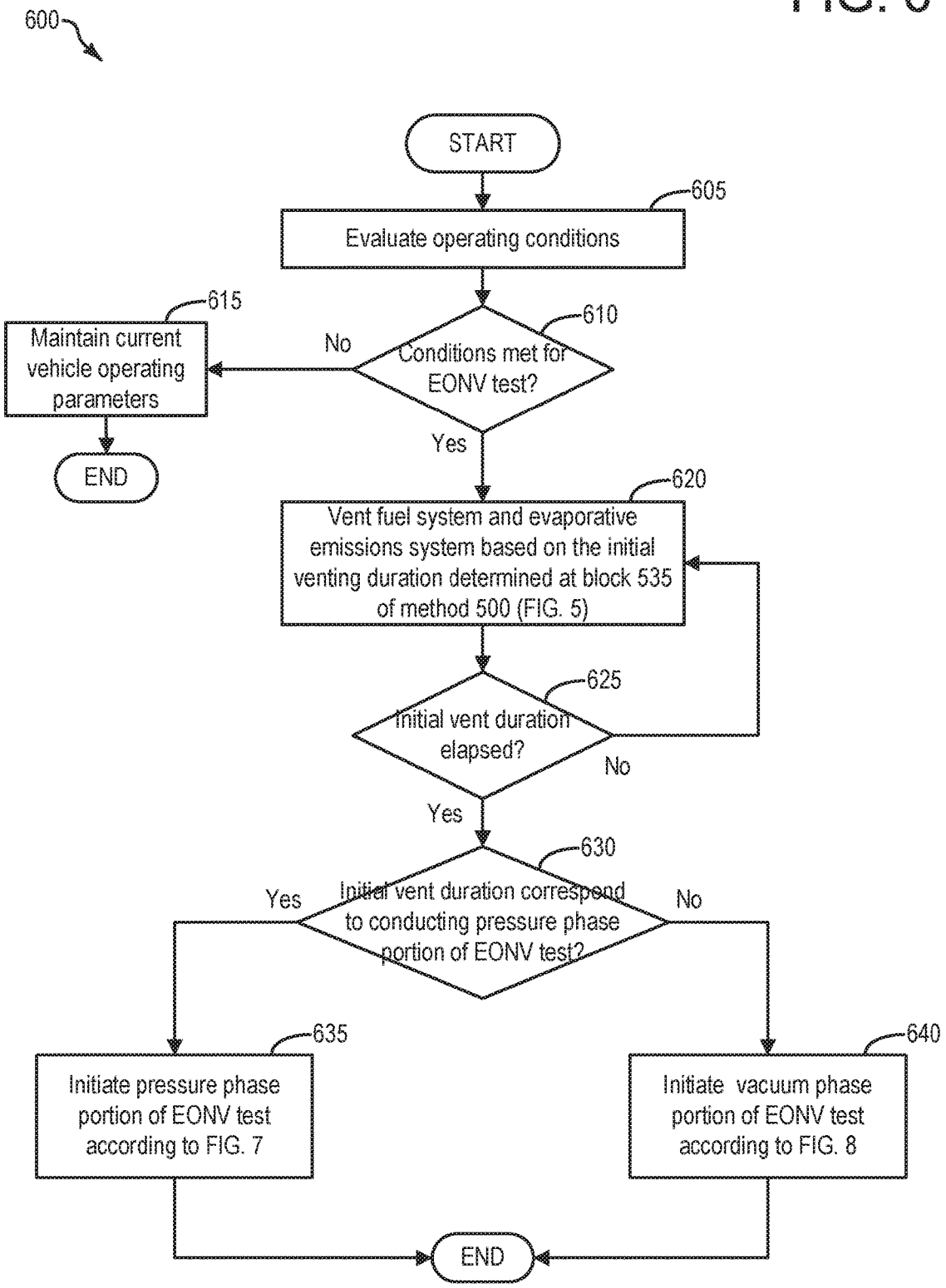
FIG. 6 shows a high-level flowchart for venting the fuel system and evaporative emissions system prior to conducting the EONV test.
Figure 7:
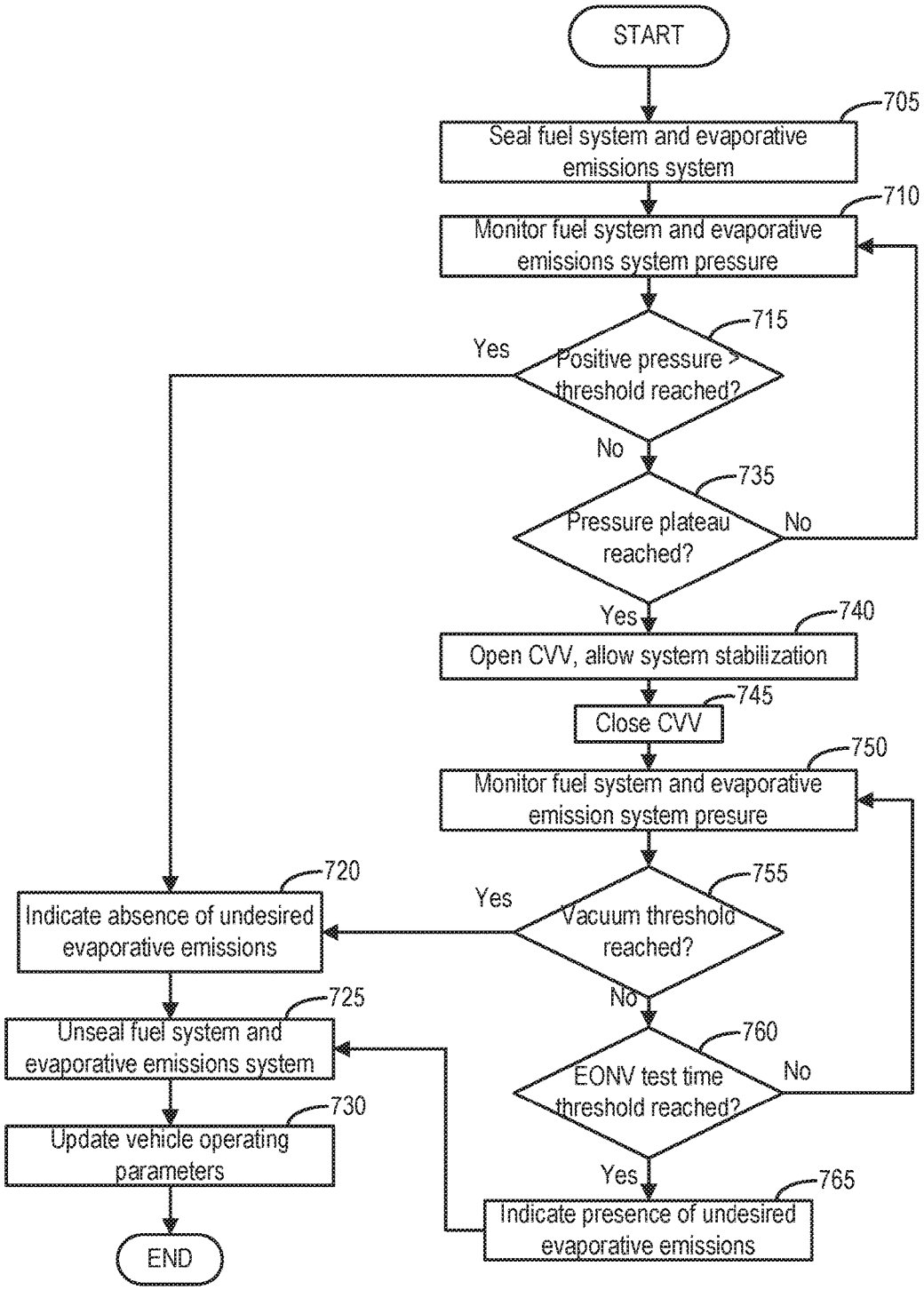
FIG. 7 shows a high-level flowchart for conducting an EONV test with a pressure phase followed by a vacuum phase.
Figure 8:
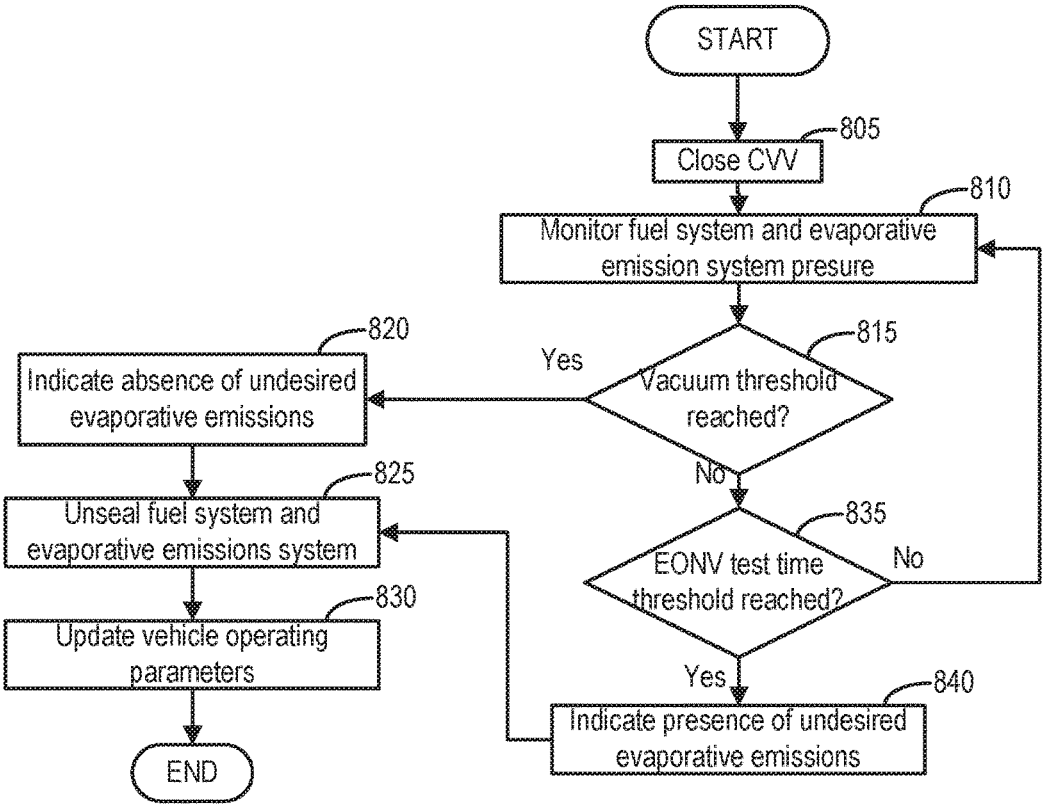
FIG. 8 shows a high-level flowchart for conducting an EONV test with only the vacuum phase.
Figure 9:
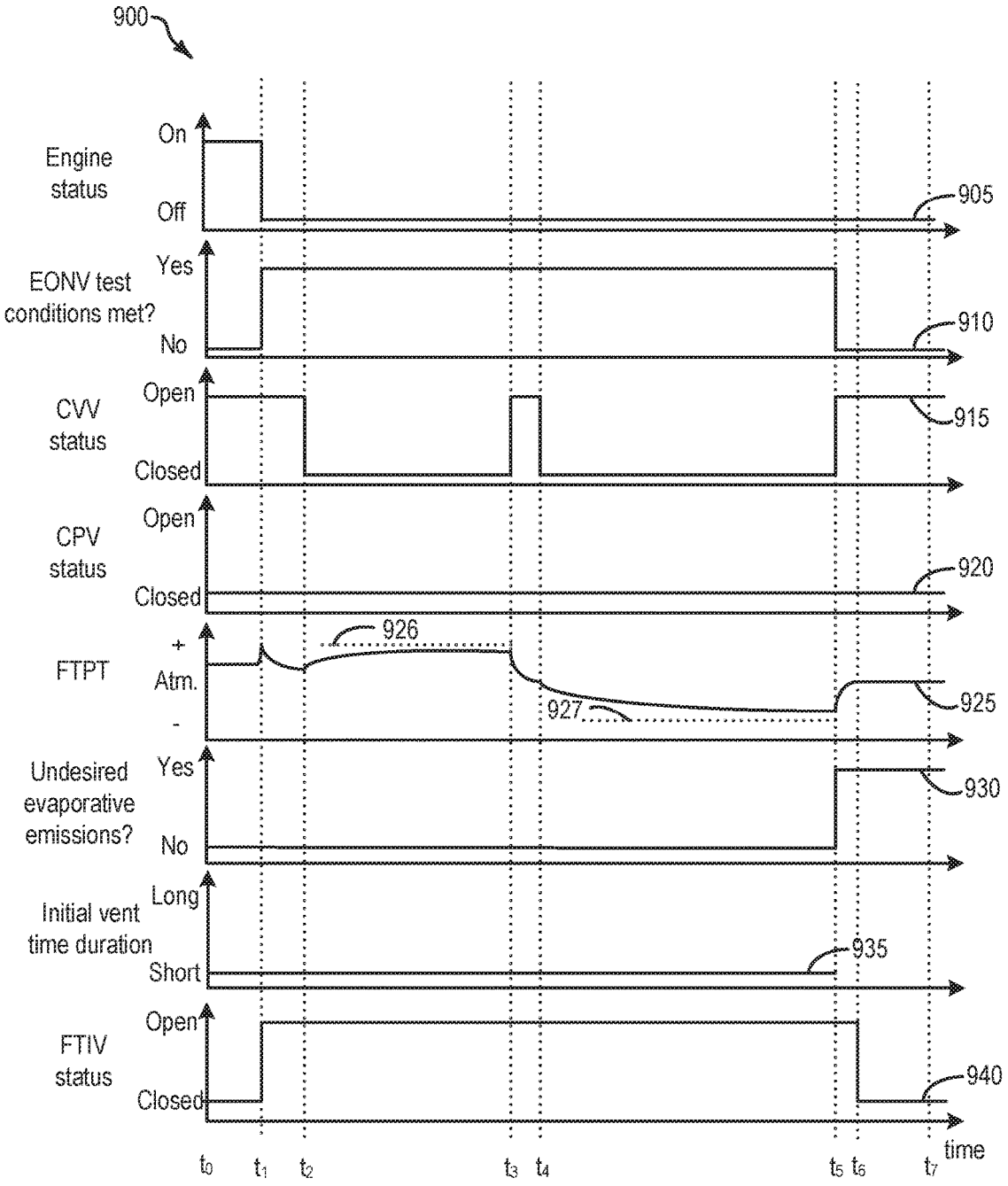
FIG. 9 shows an example timeline for conducting an EONV test with the pressure phase followed by the vacuum phase.
Figure 10:
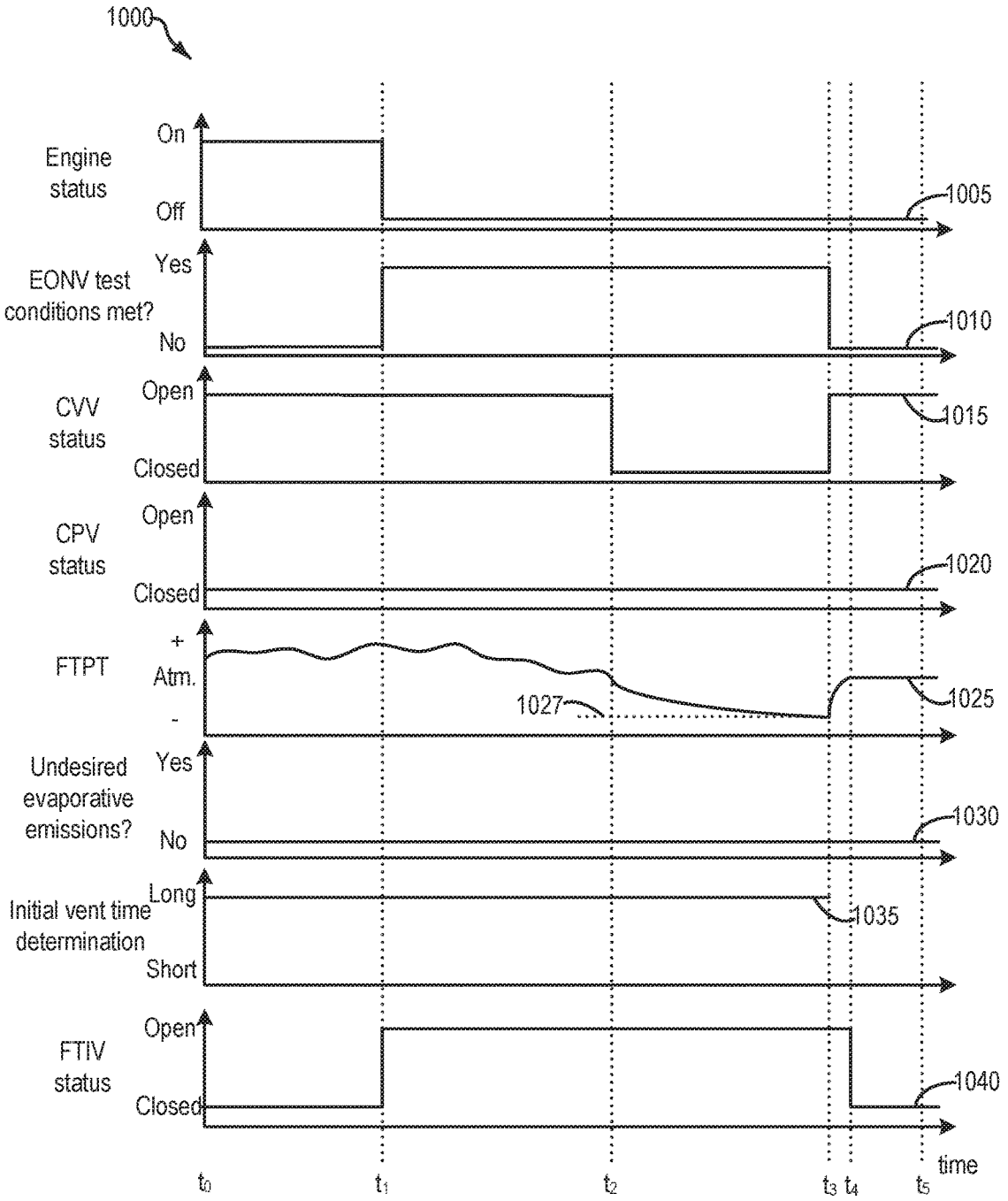
FIG. 10 shows an example timeline for conducting an EONV test with only the vacuum phase.

Depending on whether it is determined to conduct the EONV test based on the positive pressure build, or the negative pressure build, an initial vent duration subsequent to a key-off event and just prior to sealing the fuel system and evaporative emissions system to conduct the EONV test, may be different (e.g. initial vent duration may be short or long, depending on whether the EONV test starts with a positive pressure build, or negative pressure build, respectively). Thus, a method to determine an initial vent time as a function of whether the desired EONV test comprises a positive pressure build diagnostic, or a negative pressure build diagnostic, is illustrated at FIG. 5. A method for conducting the initial venting procedure, is depicted at FIG. 6. FIG. 7 depicts an example method for conducting the EONV test starting with the positive pressure build, while FIG. 8 depicts an example method for conducting the EONV test starting with the negative pressure build. A timeline illustrating a condition where the vehicle fuel system and evaporative emissions system is diagnosed by an EONV test that starts with a positive pressure build is illustrated at FIG. 9. A timeline illustrating a condition where the vehicle fuel system and evaporative emissions system is diagnosed by an EONV test that starts with the negative pressure build, is illustrated at FIG. 10.

Figure 1:
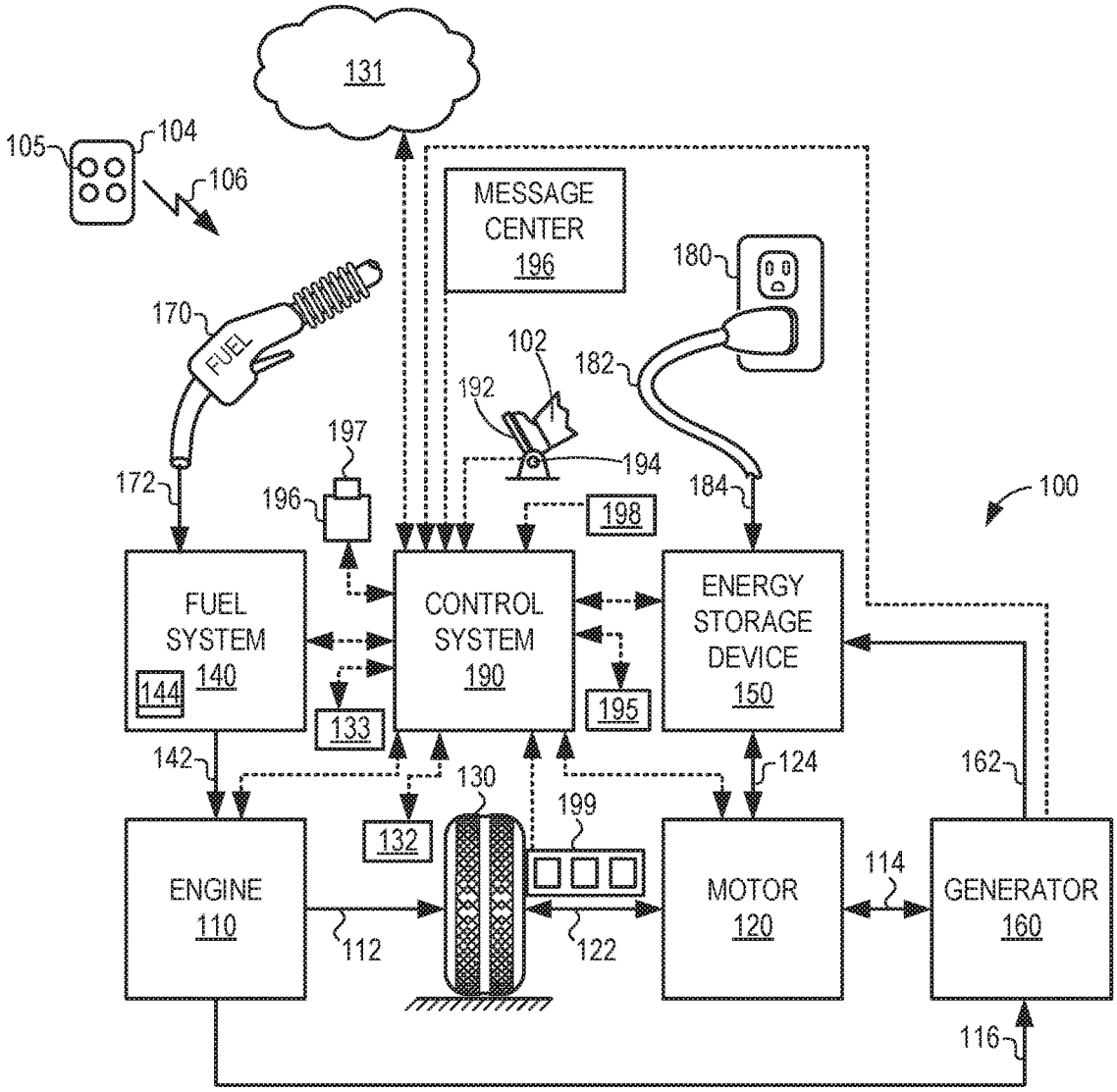
FIG. 1 schematically shows an example vehicle propulsion system.
Figure 2:
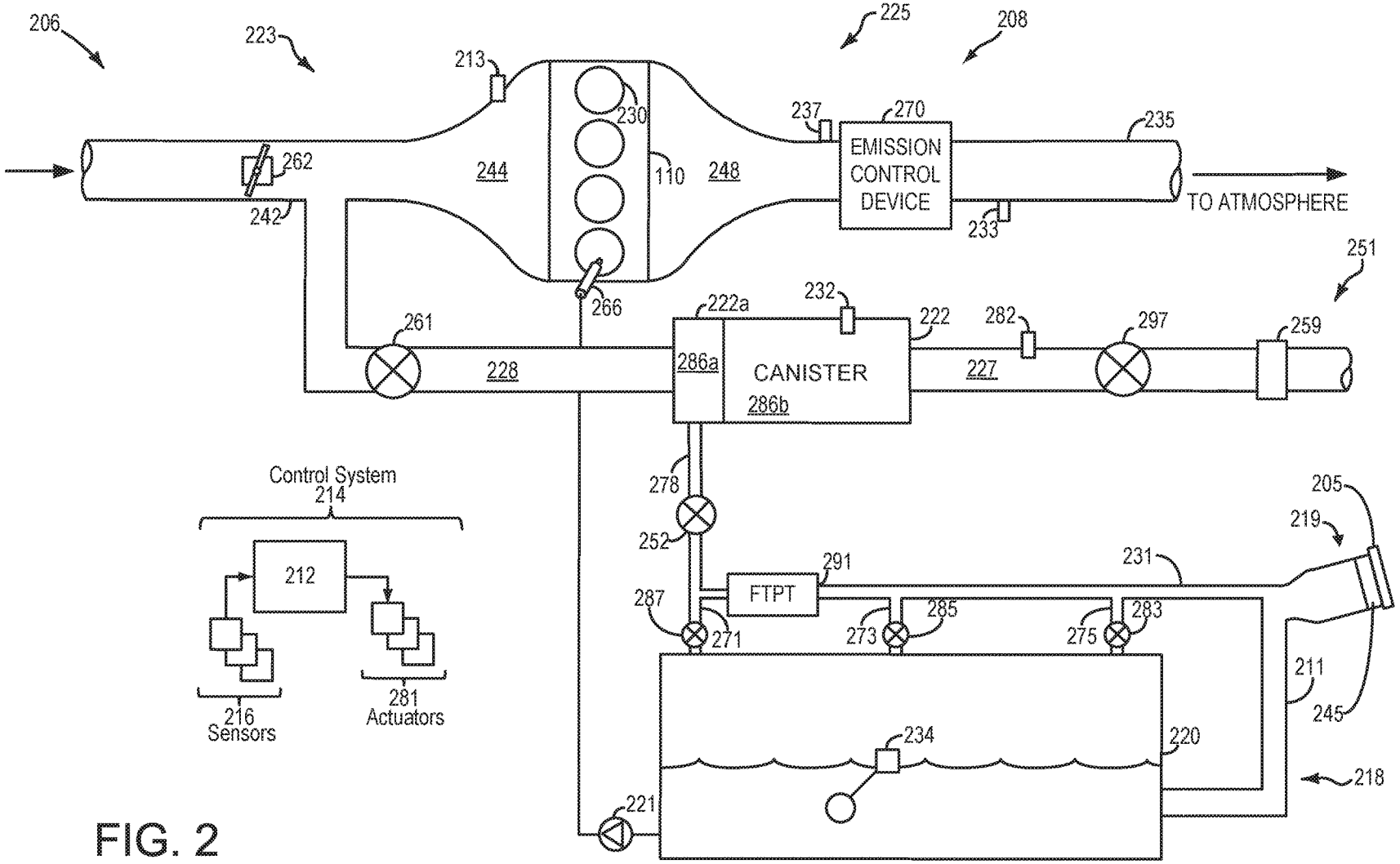
FIG. 2 schematically shows an example vehicle system with a fuel system and an evaporative emissions system.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone, or smartphone based system where a user's cellular telephone sends data to a server and the server communicates with the vehicle to start the engine.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

Control system 190 may be communicatively coupled to other vehicles or infrastructures using appropriate communications technology, as is known in the art. For example, control system 190 may be coupled to other vehicles or infrastructures via a wireless network 131, which may comprise Wi-Fi, Bluetooth, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. The communication and the information exchanged between vehicles can be either direct between vehicles, or can be multi-hop. In some examples, longer range communications (e.g. WiMax) may be used in place of, or in conjunction with, V2V, or V2I2V, to extend the coverage area by a few miles. In still other examples, vehicle control system 190 may be communicatively coupled to other vehicles or infrastructures via a wireless network 131 and the internet (e.g. cloud), as is commonly known in the art. In some examples, control system may be coupled to other vehicles or infrastructures via wireless network 131, in order to retrieve information that may be applicable to route-learning, as will be discussed in detail below.

Vehicle system 100 may also include an on-board navigation system 132 (for example, a Global Positioning System) that an operator of the vehicle may interact with. The navigation system 132 may include one or more location sensors for assisting in estimating vehicle speed, vehicle altitude, vehicle position/location, etc. This information may be used to infer engine operating parameters, such as local barometric pressure. As discussed above, control system 190 may further be configured to receive information via the internet or other communication networks. Information received from the GPS may be cross-referenced to information available via the internet to determine local weather conditions, local vehicle regulations, etc. In one example, information received from the GPS may be utilized in conjunction with route learning methodology, such that routes commonly traveled by a vehicle may be learned by the vehicle control system 190. In some examples, other sensors, such as lasers, radar, sonar, acoustic sensors, etc., (e.g. 133) may be additionally or alternatively utilized in conjunction with the onboard navigation system to conduct route learning of commonly traveled routes by the vehicle.

FIG. 2 shows a schematic depiction of a vehicle system 206. It may be understood that vehicle system 206 may comprise the same vehicle system as vehicle system 100 depicted at FIG. 1. The vehicle system 206 includes an engine system 208 coupled to an emissions control system (evaporative emissions system) 251 and a fuel system 218. It may be understood that fuel system 218 may comprise the same fuel system as fuel system 140 depicted at FIG. 1. Emission control system 251 includes a fuel vapor container or canister 222 which may be used to capture and store fuel vapors. In some examples, vehicle system 206 may be a hybrid electric vehicle system. However, it may be understood that the description herein may refer to a non-hybrid vehicle, for example a vehicle only-equipped with an engine and not an onboard energy storage device, without departing from the scope of the present disclosure.

The engine system 208 may include an engine 110 having a plurality of cylinders 230. The engine 110 includes an engine air intake 223 and an engine exhaust 225. The engine air intake 223 includes a throttle 262 in fluidic communication with engine intake manifold 244 via an intake passage 242. Further, engine air intake 223 may include an air box and filter (not shown) positioned upstream of throttle 262. The engine exhaust system 225 includes an exhaust manifold 248 leading to an exhaust passage 235 that routes exhaust gas to the atmosphere. The engine exhaust system 225 may include one or more exhaust catalyst 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors. For example, a barometric pressure sensor 213 may be included in the engine intake. In one example, barometric pressure sensor 213 may be a manifold air pressure (MAP) sensor and may be coupled to the engine intake downstream of throttle 262. Barometric pressure sensor 213 may rely on part throttle or full or wide open throttle conditions, e.g., when an opening amount of throttle 262 is greater than a threshold, in order accurately determine BP.

Fuel system 218 may include a fuel tank 220 coupled to a fuel pump system 221. It may be understood that fuel tank 220 may comprise the same fuel tank as fuel tank 144 depicted above at FIG. 1. The fuel pump system 221 may include one or more pumps for pressurizing fuel delivered to the injectors of engine 110, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system 251 which includes a fuel vapor canister 222 via vapor recovery line 231, before being purged to the engine air intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be positioned in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some examples, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some examples, refueling lock 245 may be a filler pipe valve located at a mouth of fuel filler pipe 211. In such examples, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some examples, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In examples where refueling lock 245 is locked using an electrical mechanism, refueling lock 245 may be unlocked by commands from controller 212, for example, when a fuel tank pressure decreases below a pressure threshold. In examples where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent **286*b*, the canisters are configured to temporarily trap fuel vapors (including vaporized hydrocarbons) during fuel tank refilling operations and "running loss" (that is, fuel vaporized during vehicle operation). In one example, the adsorbent 286*b* used is activated charcoal. Emissions control system 251 may further include a canister ventilation path or vent line 227 which may route gases out of the canister 222 to the atmosphere when storing, or trapping, fuel vapors from fuel system 218**.

Canister 222 may include a buffer **222*a* (or buffer region), each of the canister and the buffer comprising the adsorbent. As shown, the volume of buffer 222*a* may be smaller than (e.g., a fraction of) the volume of canister 222. The adsorbent 286*a* in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222**. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve 297 coupled within vent line 227. When included, the canister vent valve 297 may be a normally open valve, so that fuel tank isolation valve 252 (FTIV) may control venting of fuel tank 220 with the atmosphere. FTIV 252 may be positioned between the fuel tank and the fuel vapor canister 222 within conduit 278. FTIV 252 may be a normally closed valve, that when opened, allows for the venting of fuel vapors from fuel tank 220 to fuel vapor canister 222. Fuel vapors may then be vented to atmosphere, or purged to engine intake system 223 via canister purge valve 261. As will be discussed in detail below, in some example the FTIV may not be included, whereas in other examples, an FTIV may be included. Accordingly, the use of an FTIV will be discussed with regard to the methods described below, where relevant.

Fuel system 218 may be operated by controller 212 in a plurality of modes by selective adjustment of the various valves and solenoids. It may be understood that control system 214 may comprise the same control system as control system 190 depicted above at FIG. 1. For example, the fuel system may be operated in a fuel vapor storage mode (e.g., during a fuel tank refueling operation and with the engine not combusting air and fuel), wherein the controller 212 may open isolation valve 252 (when included) while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252 (when included), while maintaining canister purge valve 261 closed, to depressurize the fuel tank before allowing enabling fuel to be added therein. As such, isolation valve 252 (when included) may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine combusting air and fuel), wherein the controller 212 may open canister purge valve 261 while closing isolation valve 252 (when included). Herein, the vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Controller 212 may comprise a portion of a control system 214. In some examples, control system 214 may be the same as control system 190, illustrated in FIG. 1. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device 270, temperature sensor 233, pressure sensor 291, pressure sensor 282, and canister temperature sensor 232. Other sensors such as pressure, temperature, air/fuel ratio, and composition sensors may be coupled to various locations in the vehicle system 206. As another example, the actuators may include throttle 262, fuel tank isolation valve 252, canister purge valve 261, and canister vent valve 297. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 4-8.

In some examples, the controller may be placed in a reduced power mode or sleep mode, wherein the controller maintains essential functions only, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors. For example, the opening of a vehicle door may trigger a return to an awake mode. In other examples, particularly with regard to the methods depicted in FIGS. 7-8, the controller may need to be awake in order to conduct such methods. In such an example, the controller may stay awake for a duration referred to as a time period where the controller is maintained awake to perform extended shutdown functions, such that the controller may be awake to conduct evaporative emissions test diagnostic routines. In another example, a wakeup capability may enable a circuit to wake the controller when refueling is underway.

Undesired evaporative emissions detection routines may be intermittently performed by controller 212 on fuel system 218 and/or evaporative emissions system 251 to confirm that undesired evaporative emissions are not present in the fuel system and/or evaporative emissions system. As such, evaporative emissions detection routines may be performed while the engine is off (engine-off test) using engine-off natural vacuum (EONV) generated due to a change in temperature and pressure at the fuel tank following engine shutdown and/or with vacuum supplemented from a vacuum pump. Alternatively, evaporative emissions detection routines may be performed while the engine is running by operating a vacuum pump and/or using engine intake manifold vacuum. In some configurations, a canister vent valve (CVV) 297 may be coupled within vent line 227. CVV 297 may function to adjust a flow of air and vapors between canister 222 and the atmosphere. The CVV may also be used for diagnostic routines. When included, the CVV may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In some examples, CVV 297 may be a solenoid valve wherein opening or closing of the valve is performed via actuation of a canister vent solenoid. In particular, the canister vent valve may be an open that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVV closed is reduced. In particular, the CVV may be closed while the vehicle is off, thus maintaining battery power while maintaining the fuel emissions control system sealed from atmosphere.

Conducting an EONV test may include four "phases". The first phase may comprise an initial vent phase. This initial vent phase is conducted to vent any vapors from a fuel slosh event from a hard stop just prior to key off. The initial vent phase may comprise 30-60 seconds, for example. The next phase of the EONV test may constitute a pressure phase. In this phase, the fuel system and evaporative emissions systems are sealed from atmosphere, and a pressure build is monitored over time. If the pressure in the fuel system and evaporative emissions system reaches a positive pressure threshold, an absence of undesired evaporative emissions may be indicated. However, if the pressure build stalls (e.g. plateaus), then the pressure in the fuel system and evaporative emissions system may be relieved, during what is referred to as the vent phase. After pressure in the fuel tank and evaporative emissions system is relieved, a vacuum phase comes next. The vacuum phase may include re-sealing the fuel system and evaporative emissions system, and monitoring a vacuum build over time. If vacuum builds to a negative pressure threshold within a predetermined duration (e.g. 45 minutes since the start of the EONV test), then an absence of undesired evaporative emissions may be indicated.

However, as discussed above, there may be circumstances that may result in false failures (e.g. indications of the presence of undesired evaporative emissions when, in fact, the fuel system and evaporative emissions system are free from the presence of undesired evaporative emissions). As an example, an EONV test in summer may result in a robust pressure build which may only take a few minutes to reach the positive pressure threshold. However, in moderate weather, with cloudy conditions, the cloudy conditions may counteract the pressure build, and may result in a situation where there is not enough heat rejection to the fuel system and evaporative emissions system to pass the EONV test. While conducting the pressure phase of the EONV test is desirable as it may take less time than the vacuum phase, and thus may result in less drain on the vehicle system battery, if the vehicle does not pass during the pressure phase, then the time spent waiting for the pressure to build to the positive pressure threshold, and the battery power used, is not useful. Furthermore, waiting for the pressure build to reach the positive pressure threshold may reduce an amount of time to conduct the vacuum phase. If the vacuum phase is not reached in the time allotted, then an indication of undesired evaporative emissions may be indicated, even for a fuel system and evaporative emissions system that is free from undesired evaporative emissions.

Other factors that can affect such an EONV test may include diurnal cycles. For example, if the pressure phase of an EONV test is being conducted during a time of the diurnal cycle where temperatures are decreasing, then the decreasing temperatures may counteract the pressure build. Thus, the inventors herein have recognized that it may be desirable in some examples to avoid the pressure phase, and instead only conduct the vacuum phase. Such concepts will be discussed further below with regard to the methods depicted at FIGS. 4-8.

Turning now to FIG. 3, an example illustration of a diurnal cycle 300 as a graph of solar intensity and temperature as a function of the time of day, is shown. Incoming solar radiation 302 begins increasing at sunrise 304, and rises to a maximum near mid-day before declining until sunset 306. As such, sunrise 304 marks a time of day near where a heat gain cycle is at its greatest, and sunset 306 marks a time of day near where a heat loss cycle is at its greatest. Accordingly, ambient temperature 308 is shown, illustrating the increase in temperature from a minimum temperature 310 near sunrise 304, and the decrease in temperature from a maximum temperature 312 prior to sunset 306. As such, if a fuel system and evaporative emissions system are sealed during the heat gain cycle, it may be expected that pressure may build in the sealed fuel system and evaporative emissions system. Alternatively, if the fuel system and evaporative emissions system are sealed during the heat loss cycle, then it may be expected that the outside temperatures may counteract a pressure build, or may serve to enhance a vacuum build. Accordingly, such information may be taken into account when conducting EONV tests, as will be discussed in detail below with regard to FIGS. 5-8.

Briefly, as mentioned above, the inventors herein have recognized that there may be circumstances where it may be desirable to conduct a vacuum phase of an EONV cycle, without first conducting the pressure phase. For example, if a plurality of other vehicles of a similar class within a predetermined radius of the vehicle being tested have recently (e.g. within a threshold duration) conducted pressure phases of EONV tests that did not result in passing results (e.g. pressure builds that did not reach the positive pressure threshold), then it may be desirable to avoid the pressure phase portion of the EONV test, as it is likely that there is some systemic reason for the other vehicles not passing EONV tests during the pressure phase. For example, weather conditions may be such that the pressure phase portion of the EONV test is stalling out. Such weather conditions may include wind, rain, a heat loss cycle of the diurnal cycle, etc. In such a circumstance, by avoiding the pressure phase and instead conducting the vacuum phase of the EONV test first, robustness and accuracy of EONV tests may be improved, and completion rates may increase. Methods for conducting the EONV test by conducting the vacuum phase without first conducting the pressure phase, are discussed below at FIGS. 5-8.

In another example, there may be certain driving routes a vehicle may regularly take, which tend to result in passing EONV test results for the pressure phase, or alternatively, routes which tend to result in failing EONV test results for the pressure phase. As an example, a vehicle may have an aggressive portion (e.g. robust heat rejection to the fuel system/evaporative emissions system) at the beginning of a drive cycle, but the end of the drive cycle may be downhill where much of the initial heat rejection is counteracted. In such an example, it may be indicated that conditions are met for conducting an EONV test (e.g. with the pressure phase first), but where in reality, conditions are not ideal for conducting the pressure phase, thus resulting in the pressure build tending to stall prior to reaching the positive pressure threshold. In another example, a vehicle may be driven at a time of day and in such a way where heat rejection is counteracted by outside air temperature (e.g. during a heat loss portion of the diurnal cycle), which may result in a pressure phase portion of the EONV test not reaching the positive pressure threshold. Such examples are meant to be illustrative, and there are many other conditions which may result in the pressure phase of an EONV test not reaching the positive pressure threshold, even though the fuel system and evaporative emissions system are free from undesired evaporative emissions.

Thus, when determining whether to conduct an EONV test without first conducting the pressure phase portion (e.g. only conducting the vacuum phase), it may be desirable to obtain information as to what route the previous drive cycle just completed, and whether such a route typically results in a passing result on a pressure phase portion of an EONV test. Such routes may thus comprise learned routes, which may be used to increase confidence in determining whether to conduct an EONV test with only a vacuum phase, or whether to conduct the EONV test beginning with the pressure phase.

Accordingly, turning now to FIG. 4, a high level example method 400 for learning common driving routes driven in a vehicle, and associating the common driving routes with EONV test result trends, is shown. More specifically, method 400 may be utilized to learn common driving routes, and may further be utilized to indicate whether certain common driving routes typically result in an EONV test either passing during a pressure phase portion, or a vacuum phase portion of the EONV test. Such information may be utilized at least in part, when determining whether to initiate an EONV test at a key-off event starting with the pressure phase portion, or whether to initiate the EONV test at key-off starting with the vacuum phase portion first, as will be discussed in further detail below with regard to the methods depicted at FIGS. 5-8.

Method 400 will be described with reference to the systems described herein and shown in FIGS. 1-2, though it should be understood that similar methods may be applied to other systems without departing from the scope of this disclosure. Method 400 may be carried out by a controller, such as controller 212 in FIG. 2, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIGS. 1-2. The controller may employ fuel system and evaporative emissions system actuators, canister vent valve (CVV) (e.g. 297), canister purge valve (CPV) (e.g. 261), etc., according to the methods depicted below.

Method 400 begins at 405 and may include indicating whether a key-on event is indicated. A key-on event may comprise an ignition key being utilized to start a vehicle either in an engine-on mode, or an electric only mode of operation. In other examples, a key-on event may comprise an ignition button on the dash, for example, being depressed. Other examples may include a key-fob (or other remote device including smartphone, tablet, etc.) starting the vehicle in either an engine-on mode, or an electric-only mode of operation. If, at 405, a key-on event is not indicated, method 400 may proceed to 410, and may include maintaining current vehicle operating parameters. For example, at 410, method 400 may include maintaining a CPV, CVV, engine, etc., in their current conformations and or current modes of operation. Method 400 may then end.

Returning to 405, responsive to a key-on event being indicated, method 400 may proceed to 415, and may include accessing vehicle location, driver information, day of the week (DOW), time of day (TOD), etc. A driver's identity may be input by the driver, or inferred based on driving habits, seat position, cabin climate control preferences, voice activated commands, etc. Vehicle location may be accessed via an onboard navigation system, for example via GPS, or other means such as via wireless communication with the internet.

Proceeding to 420, method 300 may include recording vehicle route information during the drive cycle commencing from the key-on event. In some examples, vehicle route information may be divided into one or more segments, with the one or more segments being bordered by a key-on event indicating a start location, and a key-off event indicating a final destination. However, it may be understood that there may be one or more stops between a key-on event signaling the start of a route, and a key-off event indicating arrival at a final destination. Such stop events may additionally be opportunities to conduct evaporative emissions test diagnostics depending on the duration of the stops.

At 420, the vehicle controller may continuously collect data from various sensor systems and outside sources regarding the vehicle's operations/conditions, location, traffic information, local weather information, etc. The data may be collected by, for example, GPS (e.g. 132), inertial sensors (e.g. 199), lasers, radar, sonar, acoustic sensors, etc. (e.g. 133). Other feedback signals, such as input from sensors typical of vehicles may also be read from the vehicle. Example sensors may include tire pressure sensors, engine temperature sensors, brake heat sensors, brake pad status sensors, tire tread sensors, fuel sensors, oil level and quality sensors, and air quality sensors for detecting temperature, humidity, etc. Still further, at 420, the vehicle controller may also retrieve various types of non-real time data, for example information from a detailed map, which may be stored in at the controller or which may be retrieved wirelessly.

Accordingly, data regarding a particular vehicle driving route, or trip vector, may be obtained and stored at the vehicle controller during the course of the vehicle being driven along the particular route. Proceeding to 425, method 400 may include processing the data to establish predicted/learned driving routes. For example, numerous trip vectors and corresponding information may be obtained and stored at the vehicle controller, such that predicted/learned driving routes may be achieved with high accuracy. In some examples, a vehicle may travel route(s) that are not frequently traveled (e.g. not "common"). Thus, it may be understood that route information that is not correlated significantly with commonly driven routes may be periodically forgotten, or removed, from the vehicle controller, in order to prevent the accumulation of exorbitant amounts of data pertaining to vehicle travel routines.

In some examples data collected from the vehicle travel routines including GPS data may be applied to an algorithm that feeds into one or more machine learning algorithms to determine common vehicle travel routes. Such an example is meant to be illustrative, and is not meant to be limiting. For example, any commonly used methodology for vehicle route learning may be utilized via the vehicle controller in order to establish learned travel routes without departing from the scope of this disclosure.

Learning driving routes at 425 may include determining stops between and including a starting destination and a final destination. For example, learning driving routes at 425 may include learning/predicting stops (e.g. vehicle-off events) that are typically less than a predetermined time duration (e.g. less than 45 minutes), and may further include learning/predicting stops that are typically greater than the predetermined time duration (e.g. greater than 45 minutes). In some examples, such information may be utilized to schedule future EONV tests. For example, if a learned stop is less than 45 minutes, then an EONV test may be initiated starting with the pressure phase portion only if there is a high confidence in the vehicle passing on the pressure phase portion, since if the vehicle does not pass on the pressure phase portion, then it may be likely that the test will not be completed on time, which may adversely impact completion rates. In another example, if an EONV test is less than 45 minutes and there is a low confidence in that the vehicle will pass the EONV test on the pressure phase portion, then it may be desirable to commence the EONV test with the vacuum phase portion, skipping the pressure phase portion, such that the vehicle may complete the test in the reduced timeframe. Similarly, in an example where a learned stop is greater than 45 minutes, but where there is a low confidence that the vehicle will pass on the pressure phase portion, the EONV test may be initiated with the vacuum phase portion first, skipping the pressure phase portion. In other examples, if a learned stop is greater than 45 minutes and there is a high confidence that the vehicle may be expected to pass on the pressure phase portion of the EONV test, the EONV test may be initiated with the pressure phase portion first, and if the vehicle does not pass on the pressure phase portion, then there may be ample time to conduct the vacuum phase portion of the EONV test.

Proceeding to 430, method 400 may include recording results from any EONV tests conducted for a particular driving route. For example, recording results at 430 may include recording that a particular EONV test passed on a pressure phase portion, or did not pass on a pressure phase portion. Similarly, recording results at 430 may include recording that a particular EONV test passed on a vacuum phase portion, or did not pass on a vacuum phase portion.

Proceeding to 435, method 400 may include storing information pertaining to learned driving routes and EONV test results into one or more lookup table(s) at the vehicle controller. More specifically, the one or more lookup tables may include information pertaining to whether an EONV test passed on a pressure phase portion, or a vacuum phase portion, of an EONV test at one of various learned stops. The one or more lookup tables may further include information pertaining to whether an EONV test did not pass the pressure phase and/or vacuum phase of the EONV test, at one of the various learned stops. In some examples, information pertaining to weather conditions, time of day, heat rejection estimates at a time of an EONV test, etc., may be additionally stored at the one or more lookup tables, such that passing/failing results may be further corroborated with conditions that may influence the passing/failing results of the EONV test. Such lookup tables may be accessed or retrieved at subsequent key-off events, to enable a decision to be made as to whether to conduct an EONV test at a particular stop by starting with the pressure phase portion, or the vacuum phase portion, as will be discussed in further detail below.

Proceeding to FIG. 5, a high level example method 500 for determining whether an EONV test at a key-off event is likely to pass on a pressure phase or a vacuum phase of the EONV test, and may further include setting an initial venting duration for such an EONV test. In this way, an EONV test may be initiated with a pressure phase under conditions where the EONV test is likely or expected to pass during the pressure phase portion of the EONV test, or initiated with a vacuum phase of the EONV test under conditions where the EONV test is likely or expected to pass during the vacuum phase portion of the EONV test.

Method 500 will be described with reference to the systems described herein and shown in FIGS. 1-2, though it should be understood that similar methods may be applied to other systems without departing from the scope of this disclosure. Method 500 may be carried out by a controller, such as controller 212 in FIG. 2, and may be stored at the controller as executable instructions in non-transitory memory. Instructions for carrying out method 500 and the rest of the methods included herein may be executed by the controller based on instructions stored on a memory of the controller and in conjunction with signals received from sensors of the vehicle system, such as the sensors described above with reference to FIGS. 1-2. The controller may employ fuel system and evaporative emissions system actuators, canister vent valve (CVV) (e.g. 297), canister purge valve (CPV) (e.g. 261), etc., according to the methods depicted below.

Method 500 begins at 505 and may include evaluating current vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 510, method 500 may include indicating whether conditions are met for retrieving forecast weather conditions, learned driving route information including stored results of typical EONV tests, crowd data regarding EONV test results from vehicles of a similar class under similar conditions as the vehicle undergoing method 500. Conditions being met for retrieving such information may include an indication that the vehicle is in operation, being propelled by electric power, mechanical power via the engine, or some combination of both electrical and mechanical power. Conditions being met may further include an indication of an upcoming key-off event. Such information may be stored at the vehicle controller in the form of one or more lookup tables, for example, as discussed above with regard to method 400 depicted above at FIG. 4. For example, the vehicle controller may make a logical determination based on stored lookup tables that the vehicle is navigating through a commonly traveled, or learned route, and thus it may enable a prediction of a next key-off event. In some examples, conditions being met at 510 may include an indication that a next key-off event is within a threshold duration or threshold distance from a current vehicle position or location.

In other examples, conditions being met for retrieving forecast weather conditions, learned driving route and associated EONV test results, and crowd data regarding EONV test results from vehicles of a similar class under similar conditions as the vehicle undergoing method 500, may simply include an indication that the vehicle is in operation and that the data (e.g. forecast weather conditions, learned route, crowd data) has not been acquired for a threshold duration (e.g. 5 minutes, 10 minutes, 20 minutes, etc.). As an example, responsive to an indication that the vehicle is in operation (e.g. key-on event), conditions may be met for retrieving forecast weather conditions, learned driving route, and crowd data, as discussed. Then, after the threshold duration (e.g. less than 5 minutes but greater than 1 minute, 5 minutes, 10 minutes, 20 minutes) has expired, conditions may be indicated to again be met for retrieving the forecast weather conditions, learned driving route, and crowd data. In this way, the desired data may be periodically retrieved, such that the data is continually updated during a particular drive cycle.

Conditions being met at 510 may further include an indication that there are not presently any indication of a source of undesired evaporative emissions stemming from either the fuel system or the evaporative emissions system. For example, if there is already an indication of the presence of undesired evaporative emissions stemming from the fuel system and/or evaporative emissions system, then it may not be desirable to conduct another EONV test, and accordingly, conditions may not be indicated to be met at 510 if such an condition is indicated.

Conditions being met at 510 may further include an indication that a plurality of vehicles within a threshold radius of the vehicle, and of a similar class of vehicle, have recently conducted an EONV test that included one or both of a pressure phase portion and/or vacuum phase portion of the EONV test. For example, conditions being met at 510 may include a threshold number (e.g. 3, greater than 3 but less than 5, greater than 5 but less than 10) of vehicles being indicated to have recently (e.g. within an hour or less)

conducted an EONV test under similar conditions as the vehicle undergoing method 500.

Conditions being met at 510 may further include an indication that an EONV test has not already been conducted within a predetermined duration of the current drive cycle. In other words, there may be circumstances where a vehicle is driven but where an EONV test has already been recently (e.g. within the predetermined duration) conducted on the vehicle, and thus another EONV test is not desired.

If, at 510, it is indicated that conditions are not indicated to be met for retrieving forecast weather conditions, learned driving route, and crowd data, method 500 may proceed to 515. At 515, method 500 may include maintaining current vehicle operating parameters. For example, if the vehicle is being propelled via mechanical power (e.g. engine), such operation may be maintained. Similarly, if the vehicle is being propelled via electrical power (e.g. motor operated with energy supplied from a battery), or some combination of electrical and mechanical power, such operating conditions may be maintained. Furthermore, positions of relevant valves such as the CPV, CVV, etc., may be maintained in their current configurations. Method 500 may then end.

Returning to 510, if it is indicated that conditions are met for retrieving forecast weather conditions, learned driving route, and crowd data, as discussed above, method 500 may proceed to 520. At 520, method 500 may include retrieving such information. For example, the vehicle controller may retrieve forecast weather conditions via one or more of V2X (vehicle-to-infrastructure) communication, via a vehicle on-board navigation system (e.g. GPS), via GPS cross-referenced to information available via the internet to determine local forecast weather conditions, etc. More specifically, the vehicle controller may broadcast or send a wireless signal requesting forecast weather conditions, and may receive a wireless response pertaining to the requested forecast weather conditions. Forecast weather conditions may include information pertaining to whether the current conditions correlate with a heat gain portion of the diurnal cycle, a heat loss portion of the diurnal cycle, forecasted precipitation, humidity, temperature, wind, etc., for the next predetermined duration (e.g. 30 minutes, 45 minutes, 1 hour, 2 hours, 3 hours, 4 hours, 5 hours).

At 520, retrieving information pertaining to learned driving route may include accessing or querying the one or more lookup tables discussed above with regard to FIG. 4. As discussed, such lookup tables may include information pertaining to learned driving routes along with information regarding whether an EONV test conducted upon completion of such a learned driving route typically passes on a pressure phase portion of the EONV test or a vacuum phase portion of the EONV test. More specifically, retrieving information pertaining to learned driving route at 520 may include the vehicle controller identifying that the vehicle is traveling along a learned (e.g. stored) driving route. Thus, retrieving information pertaining to learned driving route at 520 may further include indicating whether an EONV test conducted at a next key-off event typically passes on a pressure phase or vacuum phase portion of the EONV test. As mentioned above, it may be understood that retrieving information pertaining to learned driving route may include only retrieving such information if the route being traveled occurs at a similar time of day, under similar conditions, as the learned driving route. For example, if the route being traveled comprises a learned route, but is being traveled at night, then it may not be useful to retrieve information about such a learned route if the information regarding EONV test results is related to EONV tests conducted during the day. Thus, retrieving information pertaining to learned driving route may additionally include first confirming that the learned route corresponding to the current route the vehicle is traveling, also comprises similar conditions such as similar time of day as the current route, similar environmental conditions, etc.

At 520, method 500 may further include retrieving crowd data pertaining to EONV test results from a plurality of vehicles. Retrieving crowd data at 520 may include the vehicle controller sending a wireless signal to a plurality of vehicles, and receiving information wirelessly from the plurality of vehicles related to whether the plurality of vehicles recently conducted an EONV test under similar conditions as an EONV test that may be conducted by the vehicle undergoing method 500. More specifically, a wireless signal may be sent to the plurality of vehicles, requesting information related to recent drive cycle conditions and EONV test results. It may be understood that the plurality of vehicles may be selected initially as a function of distance (e.g. within a threshold radius) from the vehicle undergoing method 500. From the initial selection, only those vehicles that are indicated to have recently conducted an EONV test under similar conditions as an EONV test that may be conducted by the vehicle undergoing method 500, may be maintained selected, while information pertaining to the other vehicles may be discarded. More specifically, only those vehicles that have recently been driven under conditions that result in a similar amount of heat rejection to the fuel system and evaporative emissions system, under similar environmental and vehicle operating conditions as the vehicle undergoing method 500, may be maintained selected. From those vehicles that have been maintained selected, EONV test results including information related to whether the EONV test passed (or did not pass) during a pressure phase portion, or a vacuum phase portion, of the EONV test, may be retrieved.

Subsequent to retrieving forecast weather conditions, learned route and associated typical or expected EONV test results, and crowd data pertaining to EONV test results, method 500 may proceed to 525. At 525, method 500 may include processing the retrieved data to provide an indication as to whether an EONV test at the next key-off event is likely to pass during the pressure phase portion, or the vacuum phase portion, of the EONV test. As an example, consider a situation where the plurality of vehicles (e.g. crowd data) queried for information as to the results of EONV test results indicate that a majority of the vehicles are not passing on the pressure phase portion of the test, but instead are passing on the vacuum phase portion. Further, such a situation may include an indication that for the route the vehicle is traveling, learned route information indicates that the vehicle typically passes the EONV test on a vacuum phase portion of the test. Still further, forecast weather conditions in such an example may indicate that the time of day that the EONV test may be conducted may occur during a heat loss portion or cycle of the diurnal cycle. Thus, taking together all of the retrieved information, the controller may make a logical determination that it may be desirable to conduct the EONV test by skipping the pressure phase portion, and conduct the EONV test starting with the vacuum phase portion. In other examples, it may be determined that it is highly likely that if the fuel system and evaporative emissions system are free from undesired evaporative emissions, the vehicle may pass the EONV test on the pressure phase portion. In such an example, it may thus be determined that at the next key-off condition where conditions are indicated to be met for conducting an EONV test, commencing the test with a pressure phase portion, and if the vehicle does not pass during the pressure phase portion, the vehicle may still have a chance to pass on the vacuum portion of the test.

Proceeding to 530, method 500 may include setting an initial venting duration for the fuel system and evaporative emissions system as a function of whether the vehicle is determined to likely pass the EONV test on the pressure phase portion or the vacuum phase portion of the EONV test. As discussed above, an EONV test may typically include four phases, where the first phase comprises an initial vent phase, conducted to vent any vapors from a fuel slosh event from a hard stop just prior to key off. The initial vent phase may comprise 30-60 seconds, for example, just enough time to vent the fuel slosh vapors prior to sealing the fuel system and evaporative emissions system to conduct the pressure phase portion of the EONV test.

Thus, if it is determined at step 525 of method 500 that the next EONV test conducted by the vehicle undergoing method 500 is likely to pass the EONV test during the pressure phase portion, then the initial vent time may be maintained or set at 30-60 seconds at step 530. However, if it is indicated at step 525 that the next EONV test conducted by the vehicle undergoing method 500 is likely to pass the EONV test during the vacuum phase portion, then the initial vent time may be set to be greater than the 30-60 seconds. Herein, initial vent time corresponding to an EONV test where the pressure phase is conducted first, may be referred to as a short or first initial vent time. Alternatively, an initial vent time corresponding to an EONV test where the vacuum phase is conducted first, and where the pressure phase is skipped or avoided, may be referred to as a long, or second, initial vent time.

The long initial vent time may in some examples be variable as a function of vehicle operating conditions during the drive cycle prior to the key-off event where an EONV test is requested. For example, long initial vent time may vary depending on an amount of heat rejection to the fuel system and evaporative emissions system indicated over the course of the drive cycle prior to the key-off event where an EONV test is requested. Determination of the amount of heat rejection may be a function of engine run-time, integrated mass air flow, fuel level, ambient weather conditions, reid vapor pressure of fuel in the tank, etc., as discussed above. Thus, as an amount of heat rejection indicated increases, the long initial vent time may increase accordingly. Similarly, as the amount of heat rejection indicated decreases, the long initial vent time may decrease accordingly. It may be understood that, although variable, the long initial vent time may be greater than the short initial vent time. In other words, long initial vent time may be variable, but may be greater than 60 seconds.

It may be further understood that the long initial vent time may comprise an amount of time for pressure in the fuel system and evaporative emissions system to be relieved to such a point where, upon sealing the fuel system and evaporative emissions system, the vacuum phase may be immediately commenced. More specifically, the long initial vent time may be such that vacuum development is expected to begin at a time substantially equivalent to a time when the fuel system and evaporative emissions system is sealed, subsequent to the long initial vent time. Alternatively, the short initial vent time may be such that positive pressure is expected to develop at a time substantially equivalent to a time when the fuel system and evaporative emissions system is sealed following the short initial vent time. As will be discussed in further detail below, venting the fuel system and evaporative emissions system may include coupling the fuel system and evaporative emissions system to atmosphere to relive pressure in the fuel system and evaporative emissions system, prior to conducting the EONV test. In some examples, pressure in the fuel system and evaporative emissions system may be monitored via a fuel tank pressure transducer (e.g. 291), or fuel tank pressure sensor.

Subsequent to setting the initial vent duration (e.g. either the short initial vent time or the long initial vent time), method 500 may proceed to 535. At 535, method 500 may include storing the determined initial vent duration at a lookup table stored at the vehicle controller, for use in conducting the EONV test at the next key-off event where the EONV test is requested, as will be discussed in detail below with regard to FIG. 6.

Turning now to FIG. 6, a high-level example method 600 for venting the fuel system and evaporative emissions system prior to conducting an EONV test, is shown. More specifically, method 600 may include venting the fuel system and evaporative emissions system for a short initial vent time, or a long initial vent time, depending on the outcome of method 500 depicted at FIG. 5. As discussed above, method 500 may be utilized to determine whether it is desirable for the initial vent time to be short, corresponding to an EONV test where the pressure phase is first conducted, or long, corresponding to an EONV test where the vacuum phase is conducted, without first conducting the pressure phase. In this way, EONV tests may be conducted under conditions where robust results are expected, and where the test is expected to be completed within a timeframe of the EONV test procedure.

Method 600 will be described with reference to the systems described herein and shown in FIGS. 1-2, though it should be understood that similar methods may be applied to other systems without departing from the scope of this disclosure. Method 600 may be carried out by a controller, such as controller 212 in FIG. 2, and may be stored at the controller as executable instructions in non-transitory memory. Instructions for carrying out method 600 and the rest of the methods included herein may be executed by the controller based on instructions stored on a memory of the controller and in conjunction with signals received from sensors of the vehicle system, such as the sensors described above with reference to FIGS. 1-2. The controller may employ fuel system and evaporative emissions system actuators, canister vent valve (CVV) (e.g. 297), canister purge valve (CPV) (e.g. 261), fuel tank isolation valve (FTIV) (where included), etc., according to the methods depicted below.

Method 600 begins at 605 and may include evaluating current vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 610, method 600 may include indicating whether conditions are met for conducting an EONV test. Conditions being met for conducting an EONV test may include a vehicle-off event, which may include an engine-off event, and which may be indicated by other events, such as a key-off event. Conditions being met for conducting the EONV test may further include an indication that the stop for which the vehicle key-off event coincides is predicted/learned to be greater than a predetermined threshold duration (e.g. greater than 45 minutes if the test comprises a pressure phase and a vacuum phase, or a duration less or equal to 45 minutes if the test comprises a vacuum). Conditions being met for the EONV test at 610 may further include a threshold length of engine run time prior to the engine-off event, a threshold amount of fuel in the fuel tank, and a threshold battery state of charge. For example, the threshold length of engine run time may correspond to an amount of heat rejection where a pressure phase portion of the EONV test may be conducted, or an amount of time where an EONV test starting with a vacuum phase is expected to result in a robust vacuum build. The threshold amount of fuel may include an amount of fuel where it may be expected that, if the fuel system and evaporative emissions system are free from undesired evaporative emissions, that the level of fuel in the tank may enable a robust pressure build or robust vacuum build that may enable pressure in the fuel system and evaporative emissions system to reach the positive pressure threshold, or negative pressure threshold, respectively. The threshold amount of battery state of charge may comprise an amount of battery charge where the EONV test may be expected to complete without the battery charge being depleted, or lowered to a point where a subsequent engine start event or other vehicle operating condition (e.g. request for heating or cooling of a cabin, etc.) may be compromised.

In some examples, at 610, conditions being met for conducting an EONV test may include a heat rejection inference (HRI) greater than (or less than) a HRI threshold. In one example, the HRI may be based on an amount of heat rejected by the engine during the previous drive cycle, the timing of the heat rejected, the length of time spent at differing levels of drive aggressiveness, ambient conditions, etc. The heat rejected by the engine may be inferred based on or more of engine load, fuel injected summed over time, intake manifold air mass summed over time, miles driven, etc. In some examples, the HRI threshold may be a function of ambient temperature and fuel level. For example, for a given ambient temperature, a fuel tank with a higher fill level may require a greater amount of engine run time in order to meet the HRI threshold. More specifically, the HRI threshold may be decreased as fuel level decreases for a given ambient temperature, and increased as fuel level increases for a given ambient temperature.

Thus, in some examples, if the HRI is greater than the HRI threshold, then it may be indicated that conditions are met for conducting an EONV test commencing with the pressure phase portion (provided that method 500 also indicated that it is likely that the vehicle may pass the EONV test on the pressure phase portion). Alternatively, if the HRI is less than the HRI threshold, then it may be indicated that conditions are met for conducting an EONV test commencing with the vacuum phase portion (provided that method 500 also indicated that it is likely that the vehicle may pass the EONV test on the vacuum phase portion).

In further examples, conditions being met at 610 may include an indication that a threshold duration has elapsed since a prior EONV test where the vehicle recorded a passing result.

If, at 610, it is indicated that conditions are not met for conducting the EONV test, method 600 may proceed to 615. At 615, method 600 may include maintaining current vehicle operating parameters. For example, if a key-off event has been indicated but conditions are not indicated to be met for conducting the EONV test, then vehicle operating parameters may be maintained at 615 without conducting the EONV test. For example, a CVV (e.g. 297) may be maintained in a default configuration (e.g. open), while a CPV (e.g. 261) may be maintained in a closed configuration. Furthermore, if included, a FTIV (e.g. 252) may be maintained in a closed configuration (provided a request for refueling is not indicated). The engine may additionally be maintained off responsive to the key-off event, etc. If a key-off event was not indicated, then vehicle operating conditions associated with propelling the vehicle may be maintained (e.g. current engine operating conditions, electric motor operating conditions, etc., may be maintained). Method 600 may then end.

Returning to 610, if conditions are indicated to be met for conducting the EONV test, method 600 may proceed to 620. At 620, method 600 may include venting the fuel system and evaporative emissions system as a function of the initial venting duration stored at a lookup table at step 535 of method 500. As discussed, venting duration may comprise a short initial vent duration, where pressure may be relieved due to fuel slosh after a hard stop event, or a long initial vent duration, where pressure may be relieved such that subsequent to sealing the fuel system and evaporative emissions system after venting, the vacuum phase portion of the EONV test may be immediately conducted.

Venting the fuel system and evaporative emissions system may include commanding (e.g. actuating) or maintaining the CVV in an open configuration, such that the fuel system and evaporative emissions system may be coupled to atmosphere via the vent line (e.g. 227). In a case where the vehicle system includes a FTIV, the FTIV may be commanded or actuated open, to couple the fuel system and evaporative emissions system to atmosphere. Furthermore, a CPV may be maintained closed.

With the fuel system and evaporative emissions system coupled to atmosphere to conduct the initial vent procedure, method 600 may proceed to 625. At 625, method 600 may include indicating whether the initial vent duration has elapsed. For example, if the initial vent duration was indicated to be short, then if 30-60 seconds has passed, then it may be indicated that the short initial vent time has expired or elapsed. Alternatively, if the initial vent duration was indicated to be long, then the vent duration may be variable, as discussed above with regard to step 530 of method 500. Thus, in such a scenario, a timer may be set via the controller corresponding to the long initial vent duration, and responsive to the timer elapsing, it may be indicated that the long initial vent duration has expired or elapsed. Accordingly, in either case, at 625, if it is indicated that the initial vent duration (e.g. either short or long) has not elapsed, method 600 may include returning to step 620 where the fuel system and evaporative emissions system are continued to be vented. Alternatively, if it is indicated at step 625 that the initial vent duration has elapsed, method 600 may proceed to 630.

At 630, method 600 may include indicating whether the initial vent duration for the current EONV test corresponds to an EONV test where the pressure phase portion of the EONV test is first conducted, or whether the initial vent duration for the current EONV test corresponds to an EONV test where the vacuum phase portion of the EONV test is first conducted. As described above, if the initial vent duration comprises the short initial vent duration (e.g. 30-60 seconds), then the EONV test may comprise commencing the test with the pressure phase portion. Alternatively, if the initial vent duration comprises the long initial vent duration, then the EONV test may comprise commencing the test with the vacuum phase portion. Accordingly, at 630, if the initial vent duration corresponds to conducting the pressure phase portion of the EONV test first, then method 600 may proceed to 635. At 635, method 600 may include initiating the pressure phase portion of the EONV test according to method 700 depicted below at FIG. 7. Alternatively, if the initial vent duration does not correspond to conducting the pressure phase portion, and instead corresponds to conducting the vacuum phase portion, then method 600 may proceed to 640. At 640, method 600 may include initiating the vacuum phase portion of the EONV test, according to method 800 depicted at FIG. 8.

Turning now to FIG. 7, a high-level example method for conducting an EONV test beginning with the pressure phase portion, and followed by a vacuum phase portion (if the vehicle system does not pass on the pressure phase portion), is shown. More specifically, method 700 may proceed from method 600, where it was indicated that the initial vent time corresponds to an EONV test in which the pressure phase portion is requested to commence first, rather than a vacuum phase portion of the test.

Method 700 will be described with reference to the systems described herein and shown in FIGS. 1-2, though it should be understood that similar methods may be applied to other systems without departing from the scope of this disclosure. Method 700 may be carried out by a controller, such as controller 212 in FIG. 2, and may be stored at the controller as executable instructions in non-transitory memory. Instructions for carrying out method 700 and the rest of the methods included herein may be executed by the controller based on instructions stored on a memory of the controller and in conjunction with signals received from sensors of the vehicle system, such as the sensors described above with reference to FIGS. 1-2. The controller may employ fuel system and evaporative emissions system actuators, canister vent valve (CVV) (e.g. 297), canister purge valve (CPV) (e.g. 261), fuel tank isolation valve (FTIV) (where included), etc., according to the methods depicted below.

Method 700 begins at 705, and may include keeping the vehicle controller awake (e.g. maintaining power to the controller) and sealing the fuel system and evaporative emissions system. More specifically, the CVV may be commanded (e.g. actuated) closed in order to seal the fuel system and evaporative emissions system from atmosphere. Furthermore, the CPV may be maintained in a closed conformation (or commanded to a closed conformation) to seal the fuel system and evaporative emissions system from engine intake. Still further, in a case where a FTIV is included in the vehicle, the FTIV may be commanded open to couple the fuel system to the evaporative emissions system. More specifically, in each case described with regard to step 705, a signal may be sent from the controller to one of the CVV, CPV, and/or FTIV, actuating the valves to either closed or open positions, as discussed.

Proceeding to 710, method 700 may include monitoring fuel system and evaporative emissions system pressure for a duration. Fuel system and evaporative emissions system pressure may be monitored, for example, via a fuel tank pressure transducer (FTPT) (e.g. 291). Proceeding to 715, method 700 may include indicating whether the positive pressure threshold has been reached. The positive pressure threshold may comprise a threshold set a predetermined amount greater than atmospheric pressure. In some examples, the predetermined amount may vary, thus the positive pressure threshold may vary. For example, the positive pressure threshold may be raised (e.g. farther from atmospheric pressure) responsive to an indication of a greater amount of heat rejection to the fuel system and evaporative emission system, while the positive pressure threshold may be decreased (e.g. closer to atmospheric pressure) responsive to an indication of a lower amount of heat rejection to the fuel system and evaporative emissions system. In some examples, the positive pressure threshold may additionally be adjusted as a function of positive pressure reached by the plurality of vehicles from which EONV crowd data was retrieved according to method 500 depicted at FIG. 5. The positive pressure threshold may similarly be adjusted as a function of fuel level, reid vapor pressure of fuel in the fuel tank, ambient forecast weather conditions, etc.

At 715, responsive to an indication that the positive pressure threshold has been reached, method 700 may proceed to 720, and may include indicating an absence of undesired evaporative emissions in the fuel system and evaporative emissions system. Such an indication may be stored at the controller, for example.

Responsive to an indication of an absence of undesired evaporative emissions, method 700 may proceed to 725, and may include unsealing the fuel system and evaporative emissions system. For example, at 725, method 700 may include commanding open, or actuating open, the CVV. In some examples, where the vehicle includes an FTIV, the FTIV may be kept open responsive to commanding open the CVV, and responsive to pressure in the fuel system and evaporative emissions system reaching atmospheric pressure, the FTIV may be commanded closed.

Proceeding to 730, method 700 may include updating vehicle operating parameters. In a case where an EONV test was conducted, and where no undesired evaporative emissions are indicated, updating vehicle operating parameters at 730 may include maintaining current vehicle operating parameters. For example, a canister purge schedule may be maintained in its current scheduled state. Engine operating parameters may additionally be maintained, as no undesired evaporative emissions were indicated to be present in the fuel system and evaporative emissions system, etc.

Returning to 715, if the positive pressure threshold is not indicated to be reached, method 700 may proceed to 735. At 735, method 700 may include indicating whether a pressure plateau has been reached. For example, a pressure plateau may include pressure in the fuel system and evaporative emission system reaching a particular pressure that is below the positive pressure threshold, and which does not further continue to rise in the direction of the positive pressure threshold. In some examples, a pressure plateau may be indicated if pressure in the fuel system and evaporative emissions system reaches a level that is below the positive pressure threshold for a predetermined duration. If, at 735, a pressure plateau is not indicated, method 700 may return to 710, and may continue to monitor pressure in the fuel system and evaporative emissions system. Alternatively, at 735, if a pressure plateau is indicated, method 700 may proceed to 740.

At 740, method 700 may include commanding open the CVV, and may further include allowing pressure in the fuel system and evaporative emissions system to stabilize. For example, allowing the fuel system and evaporative emissions system to stabilize may include allowing pressure in the fuel system and evaporative emissions system to reach atmospheric pressure. In a vehicle where a FTIV is included, the FTIV may be maintained open at 740.

Responsive to pressure in the fuel system and evaporative emissions system reaching atmospheric pressure, method 700 may proceed to 745, and may include closing the CVV to once again seal the fuel system and evaporative emissions system from atmosphere and engine intake. Proceeding to 750, method 700 may include monitoring fuel system and evaporative emissions system pressure, similar to that discussed above. At 755, method 700 may include indicating whether a vacuum threshold (e.g. negative pressure threshold with respect to atmospheric pressure) has been reached in the fuel system and evaporative emissions system. Responsive to the negative pressure threshold being reached at 755, method 700 may proceed to 720, and may include indicating an absence of undesired evaporative emissions. Proceeding to 725, method 700 may include unsealing the fuel system and evaporative emissions system, such that the fuel system and evaporative emissions system pressure may return to atmospheric pressure. In examples where the vehicle includes an FTIV, the FTIV may be commanded closed responsive to pressure in the fuel system and evaporative emissions system reaching atmospheric pressure.

Proceeding to 730, method 700 may include updating vehicle operating parameters responsive to the indication of an absence of undesired evaporative emissions. As discussed above, in a case where an EONV test was conducted, and where no undesired evaporative emissions are indicated, updating vehicle operating parameters at 730 may include maintaining current vehicle operating parameters. For example, a canister purge schedule may be maintained in its current scheduled state. Engine operating parameters may be maintained, etc.

Returning to 755, responsive to the vacuum threshold not being indicated to be reached, method 700 may proceed to 760, and may include indicating whether a predetermined time duration for conducting the EONV test has expired. As discussed above, such a predetermined time duration may comprise 45 minutes, in some examples. If, at 760, the predetermined time duration for conducting the EONV test is not indicated to have been reached, then method 700 may return to 750, and may include continuing to monitor fuel system and evaporative emissions system pressure.

Alternatively, at 760, responsive to an indication that the EONV time limit has expired, and further responsive to an indication that the vacuum threshold has not been reached, method 700 may proceed to 765, and may include indicating the presence of undesired evaporative emissions. In another example, method 700 may proceed to 765 responsive to pressure in the fuel system and evaporative emissions system stabilizing (e.g. reaching a plateau) for a predetermined time duration without reaching the vacuum threshold. At 765, an indication of undesired evaporative emissions may be stored at the controller, for example. Furthermore, at 765, method 700 may include illuminating a malfunction indicator light (MIL) on the vehicle dash to alert the vehicle operator of the need to service the vehicle.

Proceeding to 725, method 700 may include unsealing the fuel system and evaporative emissions system. As discussed above, unsealing the fuel system and evaporative emissions system may include commanding open the CVV to enable pressure in the fuel system and evaporative emissions system to return to atmospheric pressure. In a vehicle that includes an FTIV, the FTIV may be commanded closed responsive to pressure in the fuel system and evaporative emissions system reaching atmospheric pressure.

Proceeding to 730, method 700 may include updating vehicle operating parameters responsive to the indication of undesired evaporative emissions stemming from the fuel system and/or evaporative emissions system. More specifically, a canister purge schedule may be updated to conduct purging operations more frequently, to reduce an amount of evaporative emissions that may be released to atmosphere. Furthermore, to reduce an amount of undesired evaporative emissions that may escape to atmosphere, the vehicle may be scheduled to operate in an electric mode of operation more frequently (e.g. whenever possible) to minimize undesired evaporative emissions. Method 700 may then end.

Turning now to FIG. 8, a high-level flowchart 800 for conducting an EONV test with only the vacuum phase, is shown. More specifically, method 800 may proceed from method 600 where it was indicated that the initial vent time corresponds to an EONV test in which the pressure phase portion is avoided or skipped, and instead the vacuum phase portion of the test is commenced.

Method 800 will be described with reference to the systems described herein and shown in FIGS. 1-2, though it should be understood that similar methods may be applied to other systems without departing from the scope of this disclosure. Method 800 may be carried out by a controller, such as controller 212 in FIG. 2, and may be stored at the controller as executable instructions in non-transitory memory. Instructions for carrying out method 800 and the rest of the methods included herein may be executed by the controller based on instructions stored on a memory of the controller and in conjunction with signals received from sensors of the vehicle system, such as the sensors described above with reference to FIGS. 1-2. The controller may employ fuel system and evaporative emissions system actuators, canister vent valve (CVV) (e.g. 297), canister purge valve (CPV) (e.g. 261), fuel tank isolation valve (FTIV) (where included), etc., according to the methods depicted below.

Method 800 begins at 805, and may include keeping the vehicle controller awake (e.g. maintaining power to the controller) and sealing the fuel system and evaporative emissions system. More specifically, the CVV may be commanded (e.g. actuated) closed in order to seal the fuel system and evaporative emissions system from atmosphere. Furthermore, the CPV may be maintained in a closed conformation (or commanded to a closed conformation) to seal the fuel system and evaporative emissions system from engine intake. Still further, in a case where a FTIV is included in the vehicle, the FTIV may be commanded open to couple the fuel system to the evaporative emissions system. More specifically, in each case described with regard to step 805, a signal may be sent from the controller to one of the CVV, CPV, and/or FTIV, actuating the valves to either closed or open positions, as discussed.

Proceeding to 810, method 800 may include monitoring fuel system and evaporative emissions system pressure for a duration. Fuel system and evaporative emissions system pressure may be monitored, for example, via a fuel tank pressure transducer (FTPT) (e.g. 291). Proceeding to 815, method 800 may include indicating whether the negative pressure threshold has been reached. The negative pressure threshold may comprise a threshold set a predetermined amount lower than atmospheric pressure. In some examples, the predetermined amount may vary, thus the negative pressure threshold may vary. In some examples, the negative pressure threshold may be adjusted as a function of negative pressure reached by the plurality of vehicles from which EONV crowd data was retrieved according to method 500 depicted at FIG. 5. The negative pressure threshold may similarly be adjusted as a function of fuel level, reid vapor pressure of fuel in the fuel tank, ambient forecast weather conditions, etc.

At 815, responsive to an indication that the positive pressure threshold has been reached, method 800 may proceed to 820, and may include indicating an absence of undesired evaporative emissions in the fuel system and evaporative emissions system. Such an indication may be stored at the controller, for example.

Responsive to an indication of an absence of undesired evaporative emissions, method 800 may proceed to 825, and may include unsealing the fuel system and evaporative emissions system. For example, at 825, method 800 may include commanding open, or actuating open, the CVV. In some examples, where the vehicle includes an FTIV, the FTIV may be kept open responsive to commanding open the CVV, and responsive to pressure in the fuel system and evaporative emissions system reaching atmospheric pressure, the FTIV may be commanded closed.

Proceeding to 830, method 800 may include updating vehicle operating parameters. In a case where an EONV test was conducted, and where no undesired evaporative emissions are indicated, updating vehicle operating parameters at 830 may include maintaining current vehicle operating parameters. For example, a canister purge schedule may be maintained in its current scheduled state. Engine operating parameters may additionally be maintained, as no undesired evaporative emissions were indicated to be present in the fuel system and evaporative emissions system, etc.

Returning to 815, if the positive pressure threshold is not indicated to be reached, method 800 may proceed to 835, and may include indicating whether a predetermined time duration for conducting the EONV test has expired. As discussed above, such a predetermined time duration may comprise 45 minutes, in some examples. However, in other examples, because the test only comprises the vacuum phase portion, the predetermined time duration may comprise a time duration substantially less than 45 minutes. For example, the predetermined time duration if only the vacuum phase portion of the EONV test is conducted, may comprise 35 minutes, 30 minutes, 25 minutes, 20 minutes or 15 minutes. If, at 835, the predetermined time duration for conducting the EONV test is not indicated to have been reached, then method 800 may return to 810, and may include continuing to monitor fuel system and evaporative emissions system pressure.

Alternatively, at 835, responsive to an indication that the EONV time limit has expired, and further responsive to an indication that the vacuum threshold has not been reached, method 800 may proceed to 840, and may include indicating the presence of undesired evaporative emissions. In another example, method 800 may proceed to 840 responsive to pressure in the fuel system and evaporative emissions system stabilizing (e.g. reaching a plateau) for a predetermined time duration without reaching the vacuum threshold. At 840, an indication of undesired evaporative emissions may be stored at the controller, for example. Furthermore, at 840, method 800 may include illuminating a malfunction indicator light (MIL) on the vehicle dash to alert the vehicle operator of the need to service the vehicle.

Proceeding to 825, method 800 may include unsealing the fuel system and evaporative emissions system. As discussed above, unsealing the fuel system and evaporative emissions system may include commanding open the CVV to enable pressure in the fuel system and evaporative emissions system to return to atmospheric pressure. In a vehicle that includes an FTIV, the FTIV may be commanded closed responsive to pressure in the fuel system and evaporative emissions system reaching atmospheric pressure.

Proceeding to 830, method 800 may include updating vehicle operating parameters responsive to the indication of undesired evaporative emissions stemming from the fuel system and/or evaporative emissions system. More specifically, a canister purge schedule may be updated to conduct purging operations more frequently, to reduce an amount of evaporative emissions that may be released to atmosphere. Furthermore, to reduce an amount of undesired evaporative emissions that may escape to atmosphere, the vehicle may be scheduled to operate in an electric mode of operation more frequently (e.g. whenever possible) to minimize undesired evaporative emissions. Method 800 may then end.

Turning now to FIG. 9, an example timeline 900 for conducting an EONV test where the EONV test includes a pressure phase followed by a vacuum phase, is shown. More specifically, timeline 900 illustrates a situation where an EONV test is requested at a key-off event, and where it is indicated that it is likely that the vehicle will pass the EONV test during a pressure phase portion of the EONV test, provided that the vehicle fuel system and evaporative emissions system is free from undesired evaporative emissions. Thus, the EONV test is commenced starting with the pressure phase, as will be discussed in detail below.

Timeline 900 includes plot 905, indicating an engine status (on or off, where on indicates the engine is combusting air and fuel), over time. Timeline 900 further includes plot 910, indicating whether conditions are met for conducting an EONV test, over time. Timeline 900 further includes plot 915 indicating a status of a CVV (e.g. 297), and plot 920, indicating a status of a CPV (e.g. 261), over time. The CVV and the CPV may either be open, or closed. Timeline 900 further includes plot 925, indicating pressure in the fuel system and/or evaporative emissions system as monitored via a FTPT (e.g. 291), over time. Pressure may either be at atmospheric pressure (Atm.), or at a positive (+) pressure with respect to atmosphere, or at a negative (−) pressure with respect to atmosphere. Line 926 represents a positive pressure threshold where, if reached during the pressure phase portion of the EONV test, is indicative of an absence of undesired evaporative emissions. Line 927 represents a negative pressure threshold where, if reached during the vacuum phase portion of the EONV test, is similarly indicative of an absence of undesired evaporative emissions. Timeline 900 further includes plot 930, indicating a presence (yes) or absence (no) of undesired evaporative emissions stemming from the fuel system and evaporative emissions system, over time. Timeline 900 further includes plot 935, indicating whether an initial vent duration for the EONV test is determined to be short, or long, over time. Timeline 900 further includes plot 940, indicating a status of a fuel tank isolation valve (FTIV) (e.g. 291), over time. The FTIV may be open, or closed. When the FTIV is open and the CVV is open, it may be understood that the fuel system and evaporative emissions system may be coupled to atmosphere. In examples where the vehicle does not include an FTIV, it may be understood that when the CVV is open, the fuel system and evaporative emissions system may be coupled to atmosphere.

At time t0 the vehicle is in operation, and the engine is combusting air and fuel (plot 905). EONV test conditions are not yet indicated to be met (plot 910), as the vehicle is in operation. The CVV is open (plot 915), the FTIV is closed (plot 940), and the CPV is closed (plot 920). Pressure in the fuel system is slightly above atmospheric pressure (plot 925). Undesired evaporative emissions are not indicated to be present in the fuel system and evaporative emissions system (plot 930). Furthermore, it may be understood that, while the vehicle is in operation, it has been determined that at the next key-off event where conditions are indicated to be met for conducting an EONV test, that the test is likely to pass on the pressure phase of the EONV test (provided the fuel system and evaporative emissions system are free from the presence of undesired evaporative emissions).

More specifically, with the vehicle in operation, it may be understood that the controller has run method 500 depicted above at FIG. 5. More specifically, during the drive cycle prior to time t0, it may be understood that the vehicle controller has retrieved information pertaining to forecast weather conditions, learned driving route information and corresponding EONV test results for the current learned driving route, and crowd data pertaining to results from EONV tests from a plurality of vehicles, conducted under a similar set of circumstances as that experienced by the vehicle during the current drive cycle. Thus, based on the retrieved data, it may be understood that the controller has identified that conditions are such that the vehicle is likely to pass an EONV test at the next key-off condition during a pressure phase of the EONV test. Thus, the initial venting duration is set to short (e.g. 30-60 seconds) (plot 935), to vent fuel vapors from a fuel slosh event resulting from the vehicle coming to a stop.

At time t1, the engine is deactivated (plot 905), and it is indicated that conditions are met for conducting an EONV test, as discussed above in detail at step 610 of method 600. Because it is indicated that the vehicle is likely to pass an EONV test during the pressure phase, the initial vent duration is set to short (e.g. 30-60 seconds), to vent fuel vapors resulting from the vehicle stop event. Accordingly, at time t1, the FTIV is commanded or actuated open, and with the CVV in an open configuration, the fuel system and evaporative emissions system are coupled to atmosphere. With the fuel system and evaporative emissions system coupled to atmosphere, the pressure resulting from the stop event is relieved (plot 925) between time t1 and t2.

At time t2, the initial vent duration (e.g. short) has elapsed, thus the CVV is commanded closed via the controller sending a signal to an actuator of the CVV, commanding it closed. With the CVV (plot 915) and CPV (plot 920) closed, the fuel system and evaporative emissions system is sealed from atmosphere and from engine intake.

With the fuel system and evaporative emissions system sealed, between time t2 and t3, pressure in the fuel system and evaporative emissions system builds. However, between time t2 and t3, a pressure plateau is reached, as discussed in detail above at step 735 of method 700. In other words, the pressure build stalled prior to reaching the positive pressure threshold (line 926). Because the fuel system and evaporative emissions system did not pass on the pressure phase portion of the EONV test, at time t3 the fuel system and evaporative emissions system are unsealed, via commanding open the CVV (plot 915). With the CVV open, the fuel system and evaporative emissions system is coupled to atmosphere, and thus pressure in the fuel system and evaporative emissions system is allowed to stabilize near atmospheric pressure. Once stabilized, at time t4, the fuel system and evaporative emissions system are again sealed by commanding closed the CVV.

With the CVV closed at time t4, a vacuum build is monitored between time t4 and t5, as the fuel system and evaporative emissions system cools, thus generating a vacuum in the sealed fuel system and evaporative emissions system. However, between time t4 and t5, the vacuum build does not reach the negative pressure threshold (plot 927). At time t5, the time allotted (e.g. 45 minutes) expires, thus to conserve battery power it is indicated that conditions are no longer met for conducting the EONV test (plot 910), and accordingly, the fuel system and evaporative emissions system are unsealed by commanding open the CVV (plot 915). Because neither the positive pressure threshold was reached, not the negative pressure threshold, during the course of the EONV test, the presence of undesired evaporative emissions are indicated (plot 930). Such an indication may include setting a MIL, and may include illuminating an indicator on the vehicle dash, notifying the vehicle operator of the need to service the vehicle. At time t6, pressure in the fuel system and evaporative emissions system has reached atmospheric pressure, thus the FTIV is closed.

Between time t6 and t7, the vehicle is maintained with the FTIV closed, and with the vehicle off, pressure in the fuel system remains near atmospheric pressure.

Furthermore, between time t6 and t7, an indication is not given as to whether an initial vent duration is short or long for a future EONV test, as conditions are no longer met for indicating such a condition since the vehicle is off, there is an indication of the presence of undesired evaporative emissions, etc.

Turning now to FIG. 10, an example timeline 1000 for conducting an EONV test starting with the vacuum phase, is shown. More specifically, timeline 1000 illustrates a situation where an EONV test is requested at a key-off event, and where it is indicated that it is likely that the vehicle will not pass the test on a pressure phase portion, and thus, the pressure phase is avoided, instead commencing the EONV test with the vacuum phase portion of the test.

Timeline 1000 includes plot 1005, indicating an engine status (on or off, where on indicates the engine is combusting air and fuel), over time. Timeline 1000 further includes plot 1010, indicating whether conditions are met for conducting an EONV test, over time. Timeline 1000 further includes plot 1015 indicating a status of a CVV (e.g. 297), and plot 1020, indicating a status of a CPV (e.g. 261), over time. The CVV and the CPV may either be open, or closed. Timeline 1000 further includes plot 1025, indicating pressure in the fuel system and evaporative emissions system as monitored via a FTPT (e.g. 291), over time. Pressure may either be at atmospheric pressure (Atm.), at a positive (+) pressure with respect to atmosphere, or at a negative (−) pressure with respect to atmosphere. Line 1027 represents a negative pressure threshold where, if reached during the vacuum phase portion of the EONV test, is indicative of an absence of undesired evaporative emissions. Timeline 1000 further includes plot 1030, indicating a presence (yes) or absence (no) of undesired evaporative emissions stemming from the fuel system and evaporative emissions system, over time. Timeline 1000 further includes plot 1035, indicating whether an initial vent duration for the EONV test is determined to be short, or long, over time. Timeline 1000 further includes plot 1040, indicating a status of a fuel tank isolation valve (FTIV) (e.g. 291), over time. The FTIV may be open, or closed. When the FTIV is open and the CVV is open, it may be understood that the fuel system and evaporative emissions system may be coupled to atmosphere. In examples where the vehicle does not include an FTIV, it may be understood that when the CVV is open, the fuel system and evaporative emissions system may be coupled to atmosphere.

At time t0 the vehicle is in operation, and the engine is combusting air and fuel (plot 1005). EONV test conditions are not yet indicated to be met (plot 1010), as the vehicle is in operation. The CVV is open (plot 1015), the FTIV is closed (plot 1040), and the CPV is closed (plot 1020).

Pressure in the fuel system and evaporative emissions system is slightly above atmospheric pressure (plot 1025). Undesired evaporative emissions are not indicated to be present in the fuel system and evaporative emissions system (plot 1030). Furthermore, it may be understood that, while the vehicle is in operation, it has been determined that at the next key-off event where conditions are indicated to be met for conducting an EONV test, that the test is likely to not pass on the pressure phase of the EONV test, but would be likely to pass (provided the fuel system and evaporative emissions system are free from the presence of undesired evaporative emissions), on a vacuum phase portion of the EONV test.

More specifically, with the vehicle in operation, it may be understood that the controller has run method 500 depicted above at FIG. 5. More specifically, during the drive cycle prior to time t0, it may be understood that the vehicle controller has retrieved information pertaining to forecast weather conditions, learned driving route information and corresponding EONV test results for the current learned driving route, and crowd data pertaining to results from EONV tests from a plurality of vehicles, conducted under a similar set of circumstances as that experienced by the vehicle during the current drive cycle. Thus, based on the retrieved data, it may be understood that the controller has identified that conditions are such that the vehicle is likely to pass an EONV test at the next key-off condition during a vacuum phase of the EONV test. Thus, the initial venting duration is set to long (e.g. greater than 30-60 seconds) (plot 1035), to vent fuel vapors from a fuel slosh event resulting from the vehicle coming to a stop. Setting the "long" initial vent duration may be variable as discussed above with regard to step 530 of method 500. Thus, in this example timeline 1000, it may be understood that the long initial vent time may be set according to step 530 of method 500.

At time t1, the engine is deactivated (plot 1005), and it is indicated that conditions are met for conducting an EONV test, as discussed above in detail at step 610 of method 600. Because it is indicated that the vehicle is likely to pass an EONV test during the vacuum phase (thus it is indicated as unlikely to pass on the pressure phase), the initial vent duration is set to long (e.g. greater than 30-60 seconds), as discussed above, to vent fuel vapors to a point where it is likely that upon sealing the fuel system and evaporative emissions system, a vacuum will start to build at a substantially equivalent time as when the fuel system and evaporative emissions system are sealed. Accordingly, at time t1, the FTIV is commanded open and the CVV is maintained open. Thus, between time t1 and t2, with the FTIV and CVV maintained in open configurations, the fuel system and evaporative emissions system are maintained coupled to atmosphere. With the fuel system and evaporative emissions system coupled to atmosphere, the pressure in the fuel system and evaporative emissions system is relieved (plot 1025) to atmosphere between time t1 and t2.

At time t2, the initial vent duration (e.g. long) has elapsed, thus the CVV is commanded closed via the controller sending a signal to an actuator of the CVV, commanding it closed. With the CVV (plot 915) and CPV (plot 1020) closed, the fuel system and evaporative emissions system is sealed from atmosphere and from engine intake.

With the fuel system and evaporative emissions system sealed, between time t2 and t3, negative pressure in the fuel system and evaporative emissions system builds. At time t3, the vacuum build in the fuel system and evaporative emissions system reaches the negative pressure threshold (line 1027). With the vacuum build having reached the negative pressure build at time t3, undesired evaporative emissions are not indicated (plot 1030). Furthermore, EONV test conditions are no longer indicated to be met (plot 1010), as the EONV test is completed at time t3. Between time t3 and t4, with the FTIV and CVV open, the fuel system and evaporative emissions system is coupled to atmosphere, and thus pressure in the fuel system and evaporative emissions system returns to atmospheric pressure. Once pressure in the fuel system and evaporative emissions system reaches atmospheric pressure (or substantially equivalent to atmospheric pressure) at time t4, the FTIV is actuated closed.

Between time t4 and t5, an indication is not given as to whether an initial vent duration is short or long for a future EONV test, as conditions are no longer met for indicating such a condition since the vehicle is off, an EONV test has just been completed, and thus conditions are not indicated to be met for retrieving information relevant to determining whether initial vent time may be long or short (see step 510 of method 500).

In this way, EONV tests may be conducted such that if it is indicated that a pressure phase portion of the EONV test is unlikely to pass, then the pressure phase may be avoided by commencing the EONV test with a vacuum phase portion. By doing so, battery power may be conserved, as a portion of the EONV test that is unlikely to provide robust results (e.g. the pressure phase in this example), is avoided. Furthermore, by avoiding the pressure phase portion of the test, which is likely to fail, it may be more likely that the EONV test will complete within an allotted time frame for conducting the test, thus potentially resulting in less false failures due to time of the test elapsing prior to the vehicle passing the test.

The technical effect is to recognize that V2V, and V2X communications may be utilized to garner information related to EONV test results conducted by a plurality of vehicles within a threshold radius of the vehicle for which an EONV test is requested. The plurality of vehicles may comprise vehicles with similar make as that of the vehicle for which the EONV test is requested, and may further include the plurality of vehicles having undergone an EONV test under similar conditions (e.g. similar drive time, engine on time, drive cycle aggressiveness, similar external weather conditions, etc.), as that of the vehicle for which the EONV test is requested. In this way, if it is indicated that the plurality of vehicles are tending to not pass a pressure portion of the EONV tests, then the pressure phase portion may be avoided for the vehicle for which the EONV test is requested.

A further technical effect is to recognize that learned driving routines may be utilized for the vehicle for which an EONV test is requested, to indicate whether subsequent to such a learned driving routine, an EONV test tends to pass (or fail) on a pressure phase portion of the test, or on a vacuum phase portion of the test. Thus, once learned that a vehicle typically does not pass on the pressure phase for a particular drive cycle, the pressure phase can be subsequently avoided provided conditions for the learned route are the same as for the vehicle requesting the EONV test. In this way, pressure phase portions of the EONV test may be avoided if it is indicated the vehicle is traveling a learned route, which typically does not result in conditions being favorable for a robust pressure phase portion of the EONV test.

A further technical effect is to recognize that weather data may be utilized to determine whether the vehicle is in a heat gain portion of a diurnal cycle, or a heat loss portion of the diurnal cycle, as such conditions may influence the outcome of an EONV test depending on whether the test involves a pressure build or a vacuum build.

A still further technical effect is to recognize that by avoiding the pressure phase portion of the EONV test under conditions where it is likely that the pressure phase portion of the EONV test will not produce robust results, battery power may be saved, and completion rates for EONV tests may be improved. Improving completion rates may improve customer satisfaction, reduce warranty claims, and may contribute to a reduction in undesired evaporative emissions.

In another representation, a method for a vehicle may comprise selecting either a pressurized or vacuum type of evaporative emissions test of a vehicle fuel system and vapor recovery system, coupled to the fuel system, based upon which would be more likely to succeed, venting the fuel system and the vapor recovery system for a time duration based on the type of emissions test selected, and conducting the selected test after the venting. In one example, the type of emissions test selected is further based upon data from other vehicles, and may further include a prior history of evaporative emissions testing by vehicle and/or the other vehicles.

The systems described herein, and with reference to FIGS. 1-2, along with the methods described herein, and with reference to FIGS. 4-8, may enable one or more systems and one or more methods. In one example, a method comprises setting an initial vent duration for an engine-off-natural-vacuum test as a function of a likelihood that a vehicle will pass the engine-off-natural-vacuum test during a pressure phase portion, or during a vacuum phase portion; and commencing the engine-off-natural-vacuum test with the vacuum phase portion responsive to the likelihood the vehicle will pass during the vacuum phase portion. In a first example of the method, the method further includes wherein commencing the engine-off-natural-vacuum test with the vacuum phase portion further comprises not conducting the pressure phase portion of the engine-off-natural-vacuum test, regardless of whether the vehicle passes the vacuum phase portion or not. A second example of the method optionally includes the first example, and further includes wherein responsive to the likelihood that the vehicle will pass the engine-off-natural-vacuum test during the pressure phase portion, commencing the engine-off-natural-vacuum test with the pressure phase portion, and then subsequently conducting the vacuum phase portion responsive to the vehicle not passing during the pressure phase portion. A third example of the method optionally includes any one or more or each of the first and second examples, and further includes wherein passing the engine-off-natural-vacuum test during the pressure phase portion further comprises pressure in a fuel system and evaporative emissions system of the vehicle reaching or exceeding a positive pressure threshold; and wherein passing the engine-off-natural-vacuum test during the vacuum phase portion further comprises pressure in the fuel system and evaporative emissions system of the vehicle reaching or exceeding a negative pressure threshold. A fourth example of the method optionally includes any one or more or each of the first through third examples, and further includes wherein the fuel system and evaporative emissions system are sealed from atmosphere during the pressure phase portion and the vacuum phase portion of the engine-off-natural-vacuum test. A fifth example of the method optionally includes any one or more or each of the first through fourth examples, and further includes wherein the initial vent duration is shorter given the likelihood that the vehicle will pass the engine-off-natural-vacuum test during the pressure phase portion, as compared to the likelihood that the vehicle will pass during the vacuum phase portion. A sixth example of the method optionally includes any one or more or each of the first through fifth examples, and further includes wherein the initial vent duration comprises 30-60 seconds given the likelihood that the vehicle will pass on the pressure phase portion; and wherein the initial vent duration comprises greater than 30-60 seconds given the likelihood that the vehicle will pass on the vacuum phase portion. A seventh example of the method optionally includes any one or more or each of the first through sixth examples, and further includes wherein the initial vent duration is variable given the likelihood that the vehicle will pass on the vacuum phase portion. An eighth example of the method optionally includes any one or more or each of the first through seventh examples, and further includes wherein the likelihood that the vehicle will pass during the pressure phase portion or during the vacuum phase portion further comprises: retrieving a set of most recent engine-off-natural-vacuum test results from a plurality of vehicles of a similar class as the vehicle, within a threshold radius of the vehicle; and responsive to an indication that the plurality of vehicles are tending to not pass the pressure phase portion of the engine-off-natural-vacuum test, commencing the engine-off-natural-vacuum test with the vacuum phase portion of the engine-off-natural-vacuum test. A ninth example of the method optionally includes any one or more or each of the first through eighth examples, and further includes wherein retrieving the set of most recent engine-off-natural-vacuum test results further comprises indicating that the set of most recent engine-off-natural-vacuum test results correspond to tests conducted subsequent to similar drive cycle and environmental conditions as a current drive cycle of the vehicle. A tenth example of the method optionally includes any one or more or each of the first through ninth examples, and further includes wherein the likelihood that the vehicle will pass during the pressure phase portion or during the vacuum phase portion further comprises: retrieving current and forecast weather conditions just prior to conducting the engine-off-natural-vacuum test, and indicating whether weather conditions support the vehicle passing during the pressure phase portion or during the vacuum phase portion. An eleventh example of the method optionally includes any one or more or each of the first through tenth examples, and further includes wherein the likelihood that the vehicle will pass during the pressure phase portion or during the vacuum phase portion is a function of learned driving routes and associated engine-off-natural-vacuum test results.

Another example of a method comprises conducting a test for undesired evaporative emissions at a key-off event stemming from a fuel system and evaporative emissions system of a vehicle beginning with a positive pressure phase portion of the test first, and then conducting a vacuum phase portion if the vehicle does not pass the test on the positive pressure phase portion, in response to an indication that the vehicle is likely to pass the test on the positive pressure phase portion; and conducting the vacuum phase portion of the test first and not conducting the positive pressure phase portion in response to an indication that the vehicle is likely to pass the test on the vacuum phase portion of the test. In a first example of the method, the method further comprises setting an initial vent duration for venting pressure from the fuel system and evaporative emissions system just after the key-off event, and just prior to sealing the fuel system and evaporative emissions system in order to conduct the test for undesired evaporative emissions stemming from the fuel system and/or evaporative emissions system, where setting the initial vent duration is a function of whether it is likely that the vehicle will pass the test for undesired evaporative emissions on either the positive pressure phase portion of the test, or the vacuum phase portion of the test, and where setting the initial vent duration includes setting a short initial vent duration given the likelihood that the vehicle will pass the test on the positive pressure phase portion of the test, and setting a long initial vent duration given the likelihood that the vehicle will pass the test on the vacuum phase portion of the test. A second example of the method optionally includes the first example, and further includes wherein the short initial vent duration includes 30-60 seconds, and wherein the long initial vent duration includes a duration greater than the short initial vent duration, and where the long initial vent duration is variable as a function of vehicle operating conditions during a most recent drive cycle just prior to the key-off event. A third example of the method optionally includes any one or more or each of the first and second examples, and further comprises indicating a presence of undesired evaporative emissions in the test responsive to positive pressure in the fuel system and evaporative emissions system of the vehicle failing to reach a positive pressure threshold during the positive pressure phase portion of the test and further responsive to pressure in the fuel system and evaporative emissions system of the vehicle failing to reach a negative pressure threshold during the vacuum phase of the test under conditions where the initial vent duration is set to the short initial vent duration, and wherein the positive pressure phase is conducted prior to the vacuum phase; and indicating the presence of undesired evaporative emissions in the test responsive to pressure in the fuel system and evaporative emission system of the vehicle failing to reach the negative pressure threshold during the vacuum phase of the test under conditions where the initial vent duration is set to the long initial vent duration, and where only the vacuum phase is conducted but not the positive pressure phase. A fourth example of the method optionally includes any one or more or each of the first through third examples, and further comprises fluidically coupling the fuel system and evaporative emissions system of the vehicle to atmosphere via commanding or maintaining open a canister vent valve positioned in a vent line of the evaporative emissions system, to relieve pressure in the fuel system and evaporative emissions system of the vehicle for the initial vent duration; and sealing the fuel system and evaporative emissions system of the vehicle by commanding closed the canister vent valve after the initial vent duration has elapsed. A fifth example of the method optionally includes any one or more or each of the first through fourth examples, and further includes wherein whether it is likely that the vehicle will pass the test on the positive pressure phase portion of the test or the vacuum phase portion of the test is a function of a set of most recent test results from a plurality of other vehicles tested under similar drive cycle conditions as the vehicle just prior to conducting the test; and wherein the set of recent test results from the plurality of other vehicles is obtained wirelessly via a controller of the vehicle.

An example of a system for a vehicle comprises a fuel system including a fuel tank fluidically coupled to an evaporative emissions system; an engine system including an engine configured to propel the vehicle by combusting air and fuel; a canister vent valve positioned in a vent line of the evaporative emissions system; a wireless communication device configured to send and receive wireless signals; and a controller storing instructions in non-transitory memory that, when executed, cause the controller to: during a current drive cycle, send one or more wireless signals to a plurality of vehicles that have recently conducted a first test for undesired evaporative emissions stemming from a fuel system and/or an evaporative emissions system of the plurality of vehicles; retrieve results of the first test from the plurality of vehicles; process retrieved results of the first test from the plurality of vehicles to indicate whether the plurality of vehicles are tending to pass or fail the first test during a pressure phase portion of the first test or a vacuum phase portion of the first test; set an initial vent time for conducting a second test for undesired evaporative emissions stemming from the fuel system and/or the evaporative emission system of the vehicle as a function of whether the plurality of vehicles are tending to pass the first test during the pressure phase portion or the vacuum phase portion of the first test; and further responsive to the first test from the plurality of vehicles tending to fail during the pressure phase portion of the first test, commencing the second test for undesired evaporative emissions with a vacuum phase portion of the second test, where the vacuum phase portion of the second test is commenced after the initial vent time for conducting the second test has elapsed. In a first example of the system, the system further includes wherein the controller stores additional instructions to set the initial vent time for conducting the second test to a short initial vent time comprising 30-60 seconds if the plurality of vehicles are indicated as tending to pass the first test during the pressure phase portion of the first test, and set the initial vent time for conducting the second test to a long initial vent time comprising a duration greater than the short initial vent time if the plurality of vehicles are indicated as tending to pass the first test during the vacuum phase portion of the first test, and where the fuel system and evaporative emissions system is sealed from atmosphere via commanding closed the canister vent valve subsequent to the initial vent time elapsing; and wherein the controller stores additional instructions to indicate a presence of undesired evaporative emissions in the second test responsive to pressure in the fuel system and evaporative emissions system of the vehicle failing to reach a positive pressure threshold during the pressure phase portion of the second test and further responsive to pressure in the fuel system and evaporative emissions system of the vehicle failing to reach a negative pressure threshold during the vacuum phase of the second test, under conditions where the initial vent time is set to the short initial vent time, and wherein the pressure phase is conducted prior to the vacuum phase; and indicate the presence of undesired evaporative emissions in the second test responsive to pressure in the fuel system and evaporative emission system of the vehicle failing to reach the negative pressure threshold during the vacuum phase of the test under conditions where the initial vent time is set to the long initial vent time, and where only the vacuum phase is conducted but not the pressure phase.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

setting an initial vent duration for an engine-off-natural-vacuum test for a vehicle based on a set of engine-off-natural-vacuum test results retrieved from a plurality of other vehicles;

commencing the engine-off-natural-vacuum test with a vacuum phase portion when it is determined that the vehicle can pass during the vacuum phase portion based on the retrieved set of engine-off-natural-vacuum test results from the plurality of other vehicles; and commencing the engine-off-natural-vacuum test with a pressure phase portion when it is determined that the vehicle can pass during the pressure phase portion based on the retrieved set of engine-off-natural-vacuum test results from the plurality of other vehicles.

2. The method of claim 1, wherein commencing the engine-off-natural-vacuum test with the vacuum phase portion further comprises not conducting the pressure phase portion of the engine-off-natural-vacuum test, regardless of whether the vehicle passes the vacuum phase portion or not.

3. The method of claim 1, wherein, when it is determined that the vehicle can pass the engine-off-natural-vacuum test during the pressure phase portion, commencing the engine-off-natural-vacuum test with the pressure phase portion, and then subsequently conducting the vacuum phase portion responsive to the vehicle not passing during the pressure phase portion.

4. The method of claim 1, wherein passing the engine-off-natural-vacuum test during the pressure phase portion further comprises pressure in a fuel system and evaporative emissions system of the vehicle reaching or exceeding a positive pressure threshold; and wherein passing the engine-off-natural-vacuum test during the vacuum phase portion further comprises pressure in the fuel system and evaporative emissions system of the vehicle reaching or exceeding a negative pressure threshold.

5. The method of claim 4, wherein the fuel system and the evaporative emissions system are sealed from atmosphere during the pressure phase portion and the vacuum phase portion of the engine-off-natural-vacuum test.

6. The method of claim 1, wherein the initial vent duration is shorter when it is determined that the vehicle can pass the engine-off-natural-vacuum test during the pressure phase portion, as compared to when it is determined that the vehicle can pass during the vacuum phase portion.

7. The method of claim 6, wherein the initial vent duration is 30-60 seconds when it is determined that the vehicle can pass during the pressure phase portion; and wherein the initial vent duration is greater than 30-60 seconds when it is determined that the vehicle can pass during the vacuum phase portion.

8. The method of claim 1, wherein the initial vent duration is variable when it is determined that the vehicle can pass during the vacuum phase portion.

9. The method of claim 1, wherein the set of engine-off-natural-vacuum test results retrieved from the plurality of other vehicles further comprises most recent engine-off-natural-vacuum test results from the plurality of other vehicles, wherein the plurality of other vehicles is of a similar class as the vehicle and is within a threshold radius of the vehicle.

10. The method of claim 9, wherein the most recent engine-off-natural-vacuum test results correspond to tests conducted subsequent to similar drive cycle and environmental conditions as a current drive cycle of the vehicle.

11. The method of claim 1, wherein determining that the vehicle can pass during the pressure phase portion or during the vacuum phase portion further comprises:

retrieving current and forecast weather conditions just prior to conducting the engine-off-natural-vacuum test, and indicating whether weather conditions support the vehicle passing during the pressure phase portion or during the vacuum phase portion.

12. The method of claim 1, wherein determining that the vehicle can pass during the pressure phase portion or during the vacuum phase portion is a function of learned driving routes and associated engine-off-natural-vacuum test results.

13. A method comprising:

conducting a test for undesired evaporative emissions at a key-off event stemming from a fuel system and an evaporative emissions system of a vehicle beginning with a positive pressure phase portion of the test first, and then conducting a vacuum phase portion if the vehicle does not pass the test during the positive pressure phase portion, in response to an indication that the vehicle can pass the test during the positive pressure phase portion; and conducting the vacuum phase portion of the test first and not conducting the positive pressure phase portion in response to an indication that the vehicle can pass the test during the vacuum phase portion of the test, wherein the indication that the vehicle can pass the test during the positive pressure phase portion and the indication that the vehicle can pass the test during the vacuum phase portion of the test are based on a set of test results retrieved wirelessly via a controller of the vehicle from a plurality of other vehicles tested after similar drive cycle conditions as the vehicle.

14. The method of claim 13, further comprising:

setting an initial vent duration for venting pressure from the fuel system and the evaporative emissions system after the key-off event and prior to sealing the fuel system and the evaporative emissions system to conduct the test for undesired evaporative emissions stemming from the fuel system and/or the evaporative emissions system, where setting the initial vent duration is a function of whether it is indicated that the vehicle can pass the test for undesired evaporative emissions during either the positive pressure phase portion of the test or the vacuum phase portion of the test, and where setting the initial vent duration includes setting a short initial vent duration when it is indicated that the vehicle can pass the test during the positive pressure phase portion of the test, and setting a long initial vent duration when it is indicated that the vehicle can pass the test during the vacuum phase portion of the test.

15. The method of claim 14, wherein the short initial vent duration includes 30-60 seconds, and wherein the long initial vent duration includes a duration greater than the short initial vent duration, and where the long initial vent duration is variable as a function of vehicle operating conditions during a most recent drive cycle of the vehicle just prior to the key-off event.

16. The method of claim 14, further comprising:

indicating a presence of undesired evaporative emissions responsive to pressure in the fuel system and the evaporative emissions system of the vehicle failing to reach a positive pressure threshold during the positive pressure phase portion of the test and further responsive to pressure in the fuel system and the evaporative emissions system of the vehicle failing to reach a negative pressure threshold during the vacuum phase of the test under conditions where the initial vent duration is set to the short initial vent duration, and wherein the positive pressure phase portion is conducted prior to the vacuum phase portion; and indicating the presence of undesired evaporative emissions responsive to pressure in the fuel system and the evaporative emission system of the vehicle failing to reach the negative pressure threshold during the vacuum phase portion of the test under conditions where the initial vent duration is set to the long initial vent duration, and where the vacuum phase portion is conducted but not the positive pressure phase portion.

17. The method of claim 14, further comprising fluidically coupling the fuel system and the evaporative emissions system of the vehicle to atmosphere via commanding or maintaining open a canister vent valve positioned in a vent line of the evaporative emissions system to relieve pressure in the fuel system and the evaporative emissions system of the vehicle for the initial vent duration; and sealing the fuel system and the evaporative emissions system of the vehicle by commanding closed the canister vent valve after the initial vent duration has elapsed.

18. A system for a vehicle, comprising:

a fuel system including a fuel tank fluidically coupled to an evaporative emissions system;

an engine system including an engine configured to propel the vehicle by combusting air and fuel;

a canister vent valve positioned in a vent line of the evaporative emissions system;

a wireless communication device configured to send and receive wireless signals; and a controller storing instructions in non-transitory memory that, when executed, cause the controller to:

during a current drive cycle, send one or more wireless signals to a plurality of other vehicles that have recently conducted a first test for undesired evaporative emissions stemming from a fuel system and/or an evaporative emissions system of the plurality of other vehicles;

retrieve results of the first test from the plurality of other vehicles;

process the retrieved results of the first test from the plurality of other vehicles to indicate whether the plurality of other vehicles are tending to pass or fail the first test during a pressure phase portion of the first test or a vacuum phase portion of the first test;

set an initial vent time for conducting a second test for undesired evaporative emissions stemming from the fuel system and/or the evaporative emissions system of the vehicle as a function of whether the plurality of other vehicles are tending to pass the first test during the pressure phase portion or the vacuum phase portion of the first test; and responsive to the first test from the plurality of other vehicles tending to fail during the pressure phase portion of the first test, commencing the second test for undesired evaporative emissions with a vacuum phase portion of the second test, where the vacuum phase portion of the second test is commenced after the initial vent time for conducting the second test has elapsed.

19. The system of claim 18, wherein the controller stores additional instructions to set the initial vent time for conducting the second test to a short initial vent time comprising 30-60 seconds if the plurality of other vehicles is indicated as tending to pass the first test during the pressure phase portion of the first test, and set the initial vent time for conducting the second test to a long initial vent time comprising a duration greater than the short initial vent time if the plurality of other vehicles is indicated as tending to pass the first test during the vacuum phase portion of the first test, and where the fuel system and the evaporative emissions system are sealed from atmosphere via commanding closed the canister vent valve subsequent to the initial vent time elapsing;

wherein the controller stores additional instructions to indicate a presence of undesired evaporative emissions in the second test responsive to pressure in the fuel system and the evaporative emissions system of the vehicle failing to reach a positive pressure threshold during the pressure phase portion of the second test and further responsive to pressure in the fuel system and the evaporative emissions system of the vehicle failing to reach a negative pressure threshold during the vacuum phase portion of the second test, under conditions where the initial vent time is set to the short initial vent time, and wherein the pressure phase portion is conducted prior to the vacuum phase portion; and indicate the presence of undesired evaporative emissions in the second test responsive to pressure in the fuel system and the evaporative emission system of the vehicle failing to reach the negative pressure threshold during the vacuum phase portion of the test under conditions where the initial vent time is set to the long initial vent time, and where the vacuum phase portion is conducted but not the pressure phase portion.

* * * * *